US006412280B1

(12) United States Patent
Simonds

(10) Patent No.: US 6,412,280 B1
(45) Date of Patent: Jul. 2, 2002

(54) FLUID MOTOR

(75) Inventor: Edward L. Simonds, Adel, IA (US)

(73) Assignee: Thermal Dynamics, Inc., Adel, IA (US)

( * ) Notice: Subject to any disclaimer, the term of this patent is extended or adjusted under 35 U.S.C. 154(b) by 0 days.

(21) Appl. No.: 09/569,915

(22) Filed: May 11, 2000

(51) Int. Cl.[7] ..... F01K 1/00
(52) U.S. Cl. ..... 60/643; 418/83
(58) Field of Search ..... 60/643, 645; 418/259, 418/83

(56) References Cited

U.S. PATENT DOCUMENTS

| | | | | |
|---|---|---|---|---|
| 392,999 A | | 6/1888 | Warren | |
| 1,492,456 A | | 4/1924 | Hansen-Ellenhammer | |
| 2,636,480 A | | 4/1953 | Becker | |
| 2,671,411 A | | 3/1954 | Rhine | |
| 3,804,562 A | * | 4/1974 | Hansson | 418/107 |
| 3,988,083 A | | 10/1976 | Shimizu et al. | |
| 4,789,317 A | * | 12/1988 | Waser et al. | 418/259 X |
| 4,898,524 A | * | 2/1990 | Butzen | 418/136 |
| 4,998,868 A | | 3/1991 | Sakamaki et al. | |
| 5,002,473 A | | 3/1991 | Sakamaki et al. | |
| 5,011,390 A | | 4/1991 | Sakamaki et al. | |
| 5,030,074 A | | 7/1991 | Sakamaki et al. | |
| 5,284,427 A | * | 2/1994 | Wacker | 418/83 |
| 5,533,566 A | * | 7/1996 | Fineblum | 418/83 X |
| 5,551,854 A | | 9/1996 | Edwards | |
| 5,816,789 A | | 10/1998 | Johnson | |
| 5,961,310 A | | 10/1999 | McClure | |
| 6,024,549 A | | 2/2000 | Lee | |

FOREIGN PATENT DOCUMENTS

| | | |
|---|---|---|
| DE | 2029280 A | 12/1971 |
| JP | 61-83492 A | 4/1986 |
| JP | 1-290924 A | 11/1989 |
| WO | PCT/US81/01349 | 4/1982 |

* cited by examiner

*Primary Examiner*—Hoang Nguyen
(74) *Attorney, Agent, or Firm*—Brett J. Trout

(57) ABSTRACT

A motor or converting fluid pressure to rotational motivation and pump for moving fluid, comprising an outer race centered about a first axis and an inner race centered about a second axis. The first axis is different from, but parallel to, the second axis. A plurality of vanes is coupled for movement relative to the inner race and a fluid is provided into the vane at a pressure sufficient to cause the vane to rotationally drive the inner race relative to the outer race. Alternatively, the inner race may be driven directly to pump fluid between the inner race and the outer race.

56 Claims, 18 Drawing Sheets

FLUID MOTOR

BACKGROUND OF THE INVENTION

1. Field of the Invention

The present invention relates in general to a fluid motor for converting fluid pressure to rotational motivation, and capable of pumping fluid when rotational motivation is applied to the motor and, more specifically, to a fluid pressure motor with pumping capabilities utilizing two drums rotating on separate axes.

2. Description of the Prior Art

Motors for converting fluid pressure to rotational motivation are generally known in the art. Two types of such motors are the turbine motor and the vane motor. A turbine motor includes a circular shell, having an inlet on its circumference and an exhaust at its center. A plurality of radially-extending, curved fins is provided within the shell. Pressurized fluid is provided into the shell through the inlet. The pressurized flu;d pushes outward against the curved fins to rotate the fins before exiting through the exhaust port at the center of the circular shell.

One drawback of turbine motors is the high operating speeds typically required to develop sufficient torque. High operating speeds also make turbine motors susceptible to contamination. If particulate matter enters a turbine motor, the vanes of the turbine motor strike the particulate matter at high speed, causing damage to the vanes. Due to the high speed, even very small particulate matter can erode or destroy a vane. An additional drawback of the turbine motor is its inefficiency at low speeds. Turbine motors typically cannot start against an applied load. If a load were applied to a turbine motor before the vanes began to rotate, pressurized fluid applied through the inlet would simply exit directly out the exhaust port without rotating the vanes. Additionally, turbine motors are incapable of generating reverse rotational motion. If fluid were provided to the motor in a reverse direction, the vanes would still rotate in the same direction. Accordingly, a transmission is required to operate turbine motors efficiently at various speeds and reversing gears are required to generate reverse torque using a turbine motor.

Like a turbine motor, a vane motor has a plurality of radially-extending vanes. Unlike a turbine motor, however, the vanes of a vane motor are straight and extensible in relation to a center cylinder. The vanes of a vane motor are received in slots provided in the center cylinder. The vanes and center cylinder are provided within an elliptical shell. Fluid is supplied into the shell through a fluid input provided along the circumference of the shell. The fluid presses against the vanes and propels the center cylinder before exiting from an exhaust also provided along the circumference of the shell. Rotation of the center cylinder throws the vanes outward against the interior walls of the shell. Since the exterior shell is elliptical, and the vanes extend to the exterior shell, more of the vanes are exposed as the vanes pass the drive side of the exterior shell than is exposed as the vanes pass the recovery side of the exterior shell.

As the vanes pass by the drive side of the shell, the walls of the shell force the vanes into the slots. Conversely, as the vanes pass the recovery side of the shell, the vanes are thrown outward to their full extension. This extension and retraction of the vanes reduces the exposed surface area of the vanes to reduce undesired counter thrust. The vanes are, however, at least partially extended throughout the rotation. A certain portion of the fluid, therefore, presses against the vanes, imparting undesired counter force. Accordingly, a certain amount of fluid pressure goes toward applying force to the vanes in the reverse direction. Not only is this counter force unavailable to drive the vanes in the desired direction, but the counter force makes driving the vanes more difficult.

Accordingly, vane motors are a relatively inefficient conversion of fluid pressure to rotational motion. Additionally, the vanes rub against the exterior shell, reducing the lifespan of the vanes and typically requiring continuous lubrication. Operating vane motor at high speeds will often reduce the lifespan of the vanes even further. Although vane motors can produce torque at low speeds, unlike turbine motors, vane motors have a relatively narrow band of fluid pressures over which the most efficient torque is obtained. Due to this narrow band of efficiency, vane motors also must be used in conjunction with a transmission to obtain efficient rotational motion at multiple shaft speeds.

Prior art fluid pressure rotational motors typically have an outer shell containing a plurality of vanes rotating about an axis at the center of the shell. Due to their design, prior art motors have numerous unique disadvantages, as well as the common disadvantages of inefficiency of operation and a narrow band of fluid pressures over which the most efficient torque is produced. It would be desirable to provide a fluid motor with an efficient production of torque over a wide range of fluid pressures, to provide not only a stable rotational torque, but also to eliminate the need for a transmission and a reverse gear. It would also be desirable to provide a long-wearing motor capable of withstanding vane contact with small amounts of particulate matter. The difficulties encountered in the prior art discussed hereinabove are substantially eliminated by the present invention.

SUMMARY OF THE INVENTION

In an advantage provided by this invention, a fluid motor produces torque over a wide range of fluid pressures.

Advantageously, this invention provides an efficient conversion of fluid pressure to rotational motivation.

Advantageously, this invention provides a long wearing fluid motor of low cost construction.

Advantageously, this invention provides a fluid motor capable of operating with particulate matter provided within a driving fluid.

Advantageously, this invention provides a fluid motor with a reduced number of wear points.

Advantageously, this invention provides an efficient conversion of rotational motivation to fluid movement.

Advantageously, in a preferred example of this invention, a motor is provided, comprising an outer race centered about a first axis, an inner race centered about a second axis, wherein the first axis is different from, but parallel to, the second axis, a vane coupled for movement relative to the inner race, and means for providing a fluid between the outer race and inner race.

BRIEF DESCRIPTION OF THE DRAWINGS

The present invention will now be described, by way of example, with reference to the accompanying drawings in which:

FIG. 16 illustrates a rear perspective view of a fourth alternative embodiment of the present invent;on.

DETAILED DESCRIPTION OF THE PREFERRED EMBODIMENT

Figure 1:
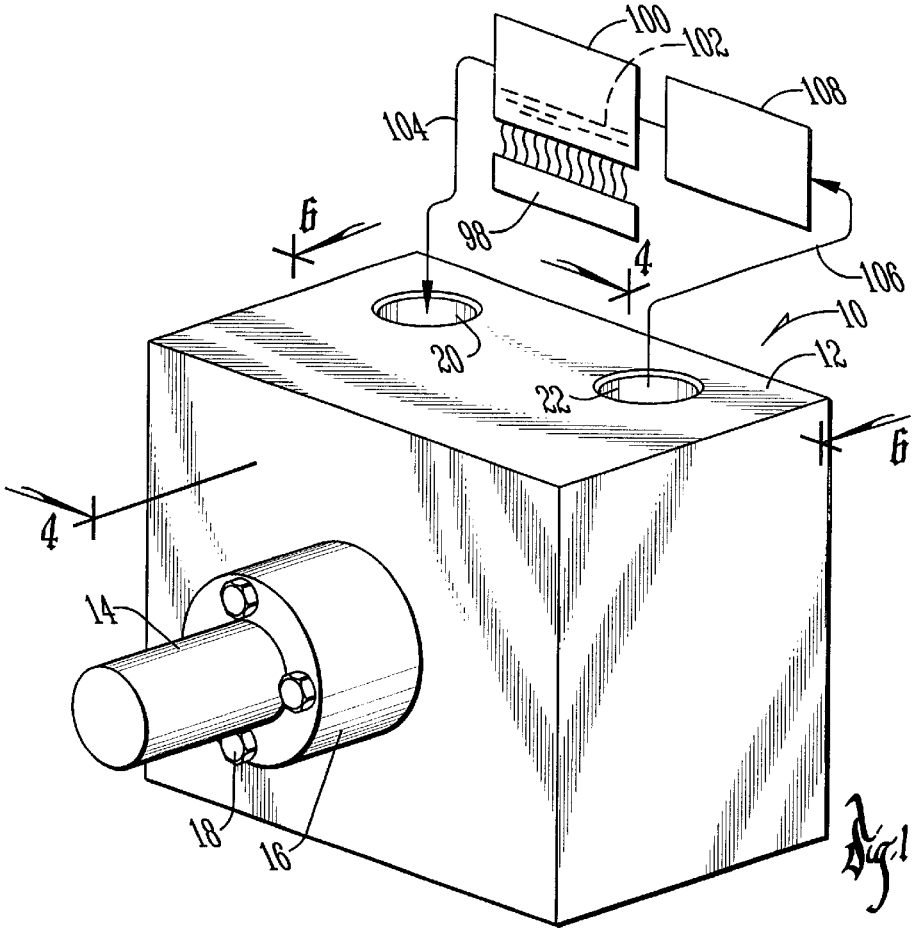
FIG. 1 illustrates an example perspective view of a motor according to this invention.
Figure 2:
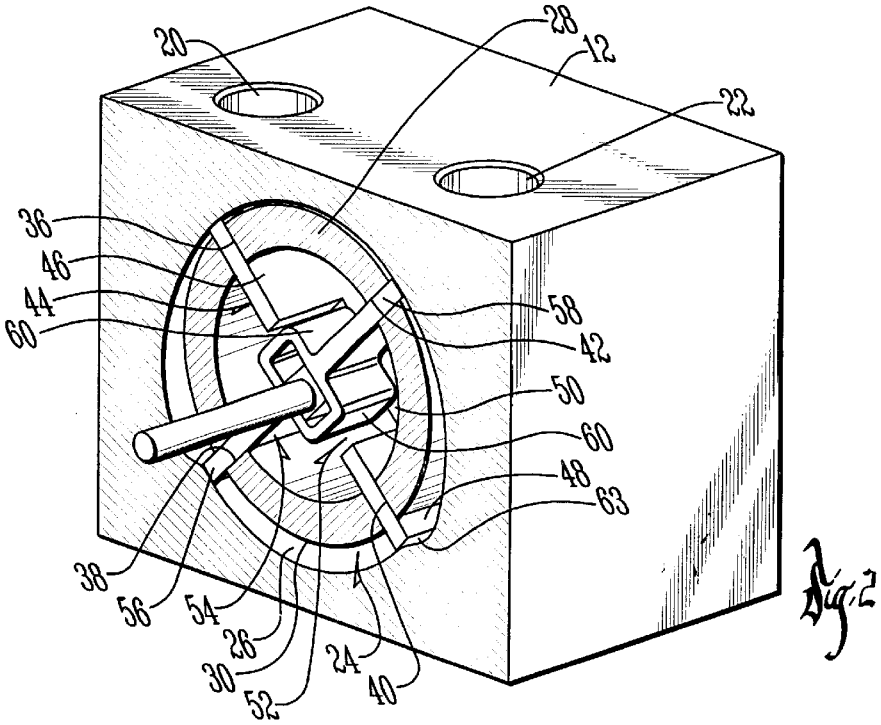
FIG. 2 illustrates a rear perspective view of the motor of FIG. 1, shown with the rear of the case and the shaft bushings removed.
Figure 4:
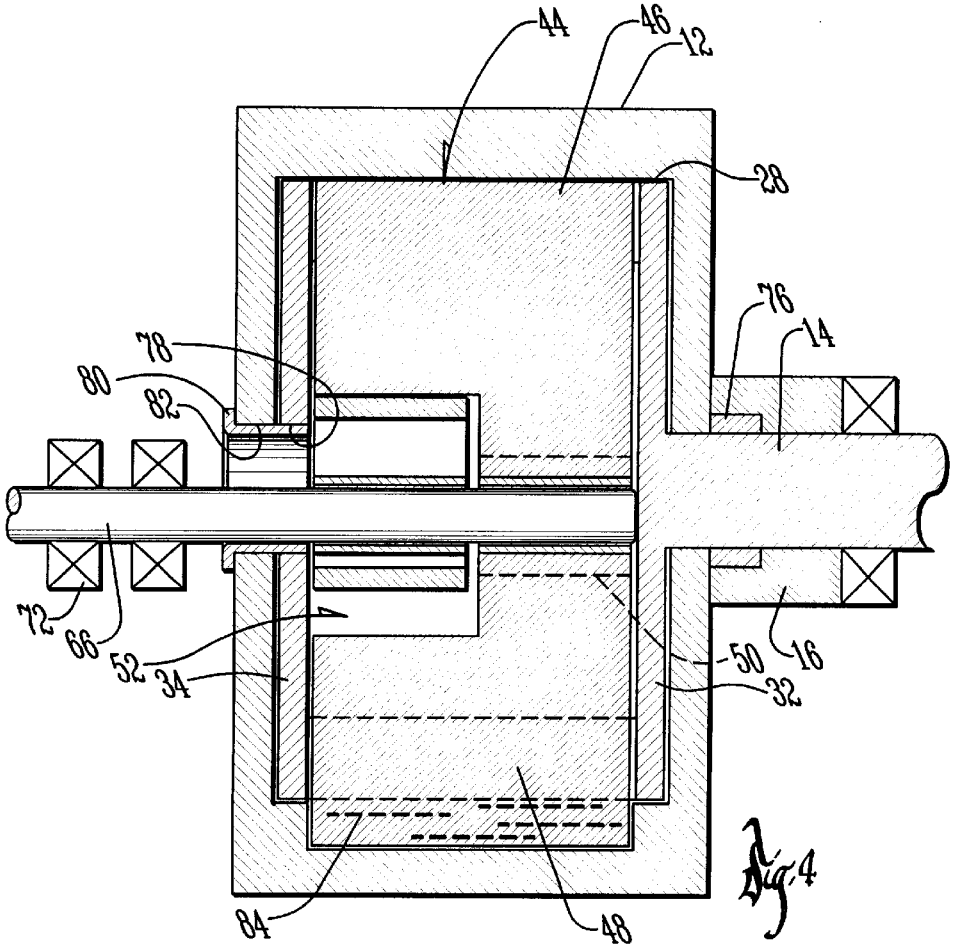
FIG. 4 illustrates a side elevation cross-section of the motor taken along line 4—4 of FIG. 1 shown with the vanes in the maximum-extension and maximum-retraction orientation.

Referring to FIG. 1, a motor (10) according to this invention is shown with a drive shaft (14) coupled to a casing (12) by a bushing (16). The bushing (16), in turn, is secured to the casing (12) by bolts (18). As shown in FIG. 2, the casing (12) is provided with a fluid inlet (20) and a fluid outlet (22). The casing (12) is provided with a hollow interior (24) in fluid communication with the inlet (20) and outlet (22). The hollow interior (24) is defined by an outer race (26). Provided within the hollow interior (24) is an inner drum (28), which comprises a front plate (32), back plate (34), and a cylindrical inner race (30). (FIGS. 2 and 4). As shown in FIG. 2, the inner race (30) is provided with a first aperture (36), a second aperture (38), a third aperture (40) and a fourth aperture (42).

Figure 5:
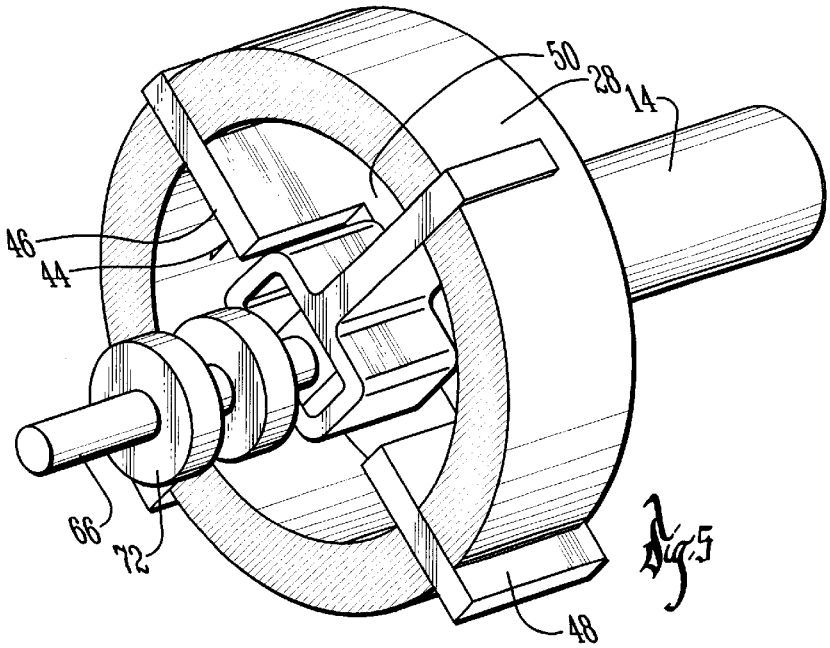
FIG. 5 illustrates a rear perspective view of the inner drum and vane assembly of the motor of FIG. 1.
Figure 7:
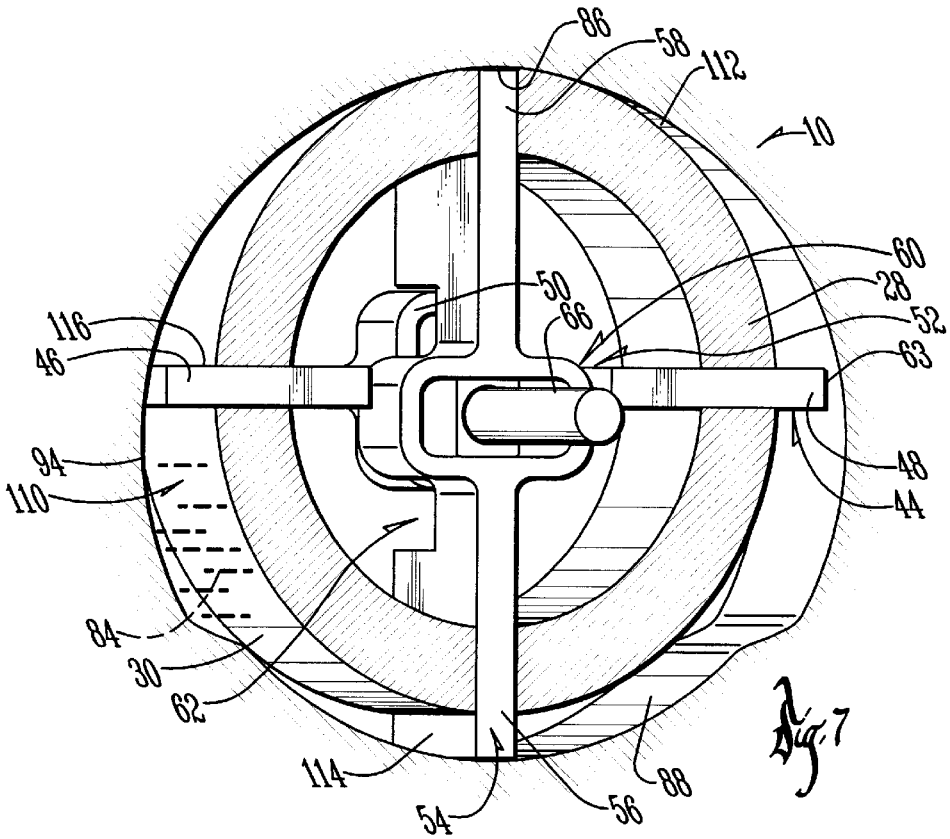
FIG. 7 illustrates a perspective view in partial cutaway of the motor of FIG. 6, shown with the vanes rotated into the maximum-extension and maximum-retraction orientation.

Provided within the inner drum (28) is a first vane assembly (44), which includes a first vane (46) and a third vane (48), each secured to a lost motion linkage (50). (FIG. 5). As shown in FIG. 4, the first vane (46) and third vane (48) are wider than the first lost motion linkage (50), leaving a first C-shaped cutout (52) in the first vane assembly (44). A second vane assembly (54), is also provided, comprising a second vane (56), a fourth vane (58) and a second lost motion linkage (60). (FIG. 7). The second vane (56) and fourth vane (58) are secured to the second lost motion linkage (60) in a manner, similar to that described above, to provide a second C-shaped cutout (62).

The first vane assembly (44) and second vane assembly (54) are constructed in a manner, which positions the first vane (46) and third vane (48) perpendicular to the second vane (56) and fourth vane (58). The first lost motion linkage (50) is provided within the second C-shaped cutout (62) of the second vane assembly (54), and the second lost motion linkage (60) is provided within the first C-shaped cutout (52) of the first vane assembly (44). Preferably, the vane assemblies (44) and (54) are constructed of stainless steel and are provided near their ends (61) with wear-resistant tips (63), constructed of an aluminum nickel bronze alloy such as those alloys well known in the art, or of other known wear resistant material. The tips (63) are rounded with a tighter radius of curvature than the outer race (26). In the preferred embodiment, the curvature of the tips (63) is based upon a radius of 8.255 centimeters. The tips (63) are secured to the vane assemblies (44) and (54) by weldments or similar securement means.

Figure 6:
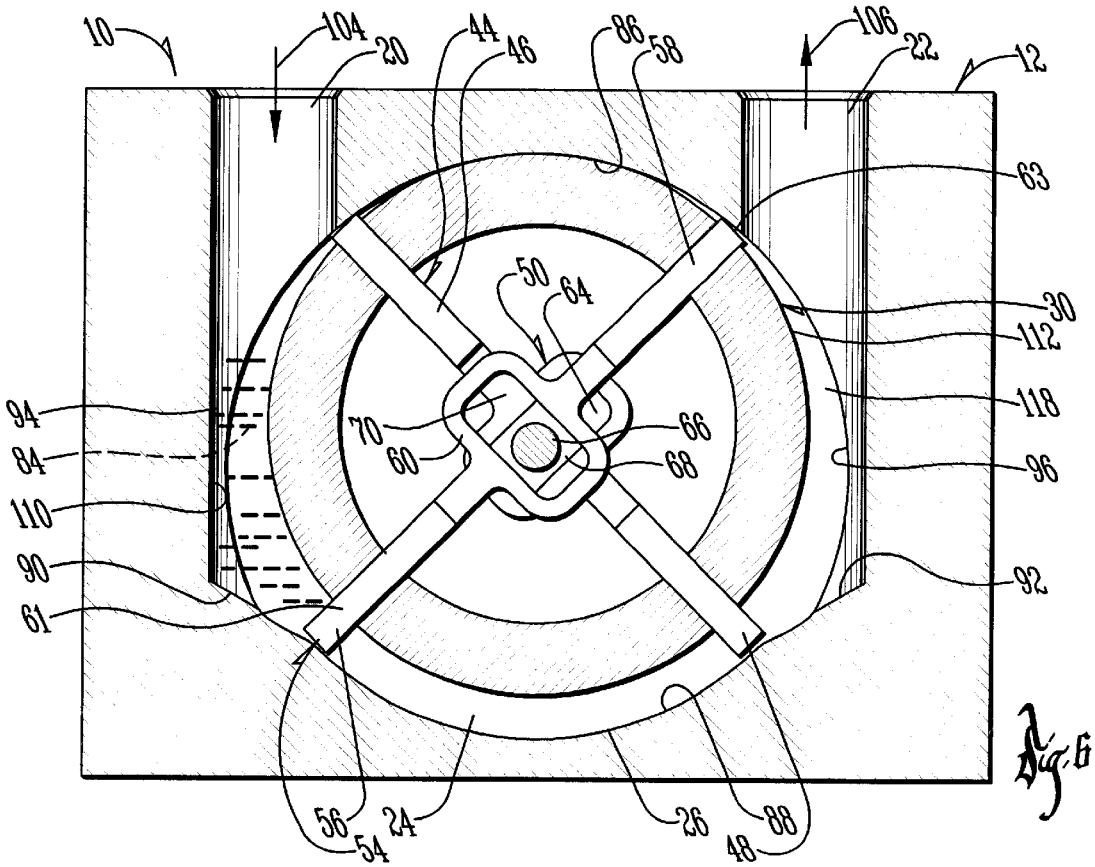
FIG. 6 illustrates a rear elevation cross-section of the motor taken along line 6—6 of FIG. 1.

As shown in FIG. 6, the first lost motion linkage (50) defines an interior space (64) with a width approximately one-half of its length. Provided within this interior space (64) is a stainless steel drum shaft (66). Secured around the drum shaft (66) is a guide block (68). The guide block (68) has a square cross-section with a width only slightly smaller than the width of the interior space (64) defined by the first lost motion linkage (50). The guide block (68) is preferably the same depth as the vanes (46), (48), (56) and (58), and extends from the interior space (64) of the first lost motion linkage (50) into an interior space (70) defined by the second lost motion linkage (60). This construction allows longitudinal movement of the vane assemblies (44) and (54) relative to the guide block (68) and drum shaft (66), but prevents lateral movement in relationship thereto.

Figure 3:
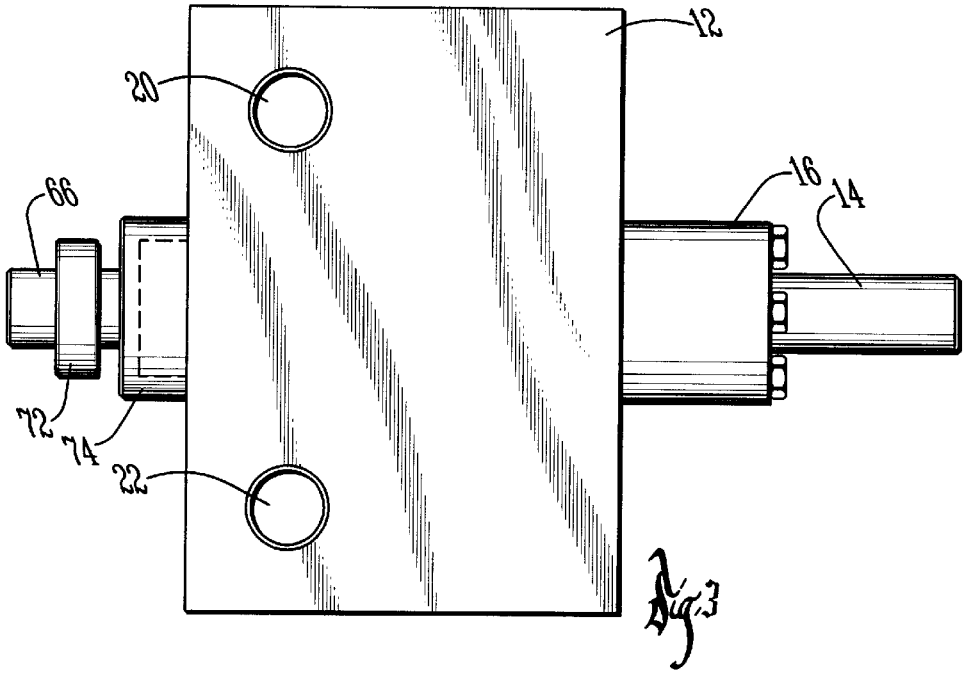
FIG. 3 illustrates a top plan view in partial phantom of the motor of FIG. 1.

As shown in FIGS. 3–5, provided around the drum shaft (66) are a pair of bearings (72), such as those well known in the art, secured to a pair of support brackets (74). As shown in FIG. 6, the drum shaft (66) is centered within the hollow interior (24) defined by the outer race (26). As can be seen in FIG. 4, the drive shaft (14) is positioned slightly higher than the drum shaft (66). The drive shaft (14) is centered on the front plate (32) and welded and secured thereto by a locking collar (76). Accordingly, the drive shaft (14) is parallel to, but on a different axis than, the drum shaft (66).

Since the shafts (14) and (66) each rotate on a different axis, the back plate (34) must be provided with a large circular aperture (78) into which is secured a bearing (80). The bearing (80) supports the inner drum (28) against the casing (12) and allows the drum shaft (66) to extend out of the casing (12) and rotate on its own axis. The bearing (80) also maintains a substantially fluid tight seal to prevent the escape of pressurized fluid (84) out of the casing (12).

As shown in FIG. 6, the inner race (30) is positioned very close to a ceiling (86) defined by the casing (12). In the preferred embodiment, the curvature of the ceiling is less than the curvature of the inner race (30). The inner race (30) is preferably positioned within five millimeters of, and, more preferably, within one millimeter of the ceiling (86), to limit the flow of pressurized fluid (84) therebetween. The inner race (30) is preferably positioned no closer than one 1/100th of a millimeter to the ceiling (86) and, more preferably, positioned no closer than one tenth of a millimeter to the ceiling (86) to reduce wear on the tips (63) of the vane assemblies (44) and (54), and to prevent particulate (not shown) from damaging the motor (10).

The outer race (26) is provided with an abrasion plate (88), preferably constructed of titanium or similar abrasion resistant material. As shown, the casing (12) is provided with a first slot (90) and a second slot (92) into which the ends of the abrasion plate (88) are friction fit. As noted above and shown in FIG. 6, the inner race (30) has a tighter radius of curvature than the ceiling (86). This provides a widening area for the vanes (46), (48), (56) and (58) to extend and retract relative to the outer race (26). As shown in FIG. 6, the casing (12) defines an intake side wall (94) and an exhaust side wall (96).

Any suitable source may be used to produce the pressurized fluid (84) to operate the motor (10), including any suitable gas or liquid known in the art (FIG. 6). In the preferred embodiment, the pressurized fluid (84) is steam, generated by a heater (98). (FIGS. 1 and 7). The heater (98) heats a heating chamber (100) provided with water (102). (FIG. 1). The heating chamber (100) is coupled by a pressure hose (104) to the inlet (20). Similarly, the outlet (22) is coupled to a return hose (106) which, in turn, is coupled to a condenser (108) in fluid communication with the heating chamber (100).

To operate the motor (10) of the present invention, the heater (98) is engaged to provide sufficient heat to the heating chamber (100) to vaporize the water (102) and move the resulting pressurized fluid (84) through the pressure hose (104) into the inlet (20) of the casing (12). (FIGS. 1 and 6). From the inlet (20), the pressurized fluid (84), enters an inlet chamber (110) defined by the intake sidewall (94) and an outer arcuate surface (112) of the inner race (30) (FIG. 6). As shown in FIG. 7, as the pressurized fluid (84) enters the inlet chamber (110), the pressurized fluid (84) presses against a face (114) of the second vane (56), forcing the inner drum (28) into a counterclockwise rotation.

As shown in FIG. 7, when the fourth vane (58) is closest to the ceiling (86), the majority of the fourth vane (58) is located within the inner drum (28). Accordingly, the amount of the fourth vane (58) exposed to the pressurized fluid (84) is reduced, as is its drag coefficient. A larger drag coefficient would allow the pressurized fluid (84) to force the inner drum (28) toward a clockwise rotation, thereby reducing the efficiency of the motor (10). As shown in FIG. 7, as the pressurized fluid (84) presses against the face (114) of the second vane (56), the second vane (56) moves along the abrasion plate (88) with the gap between the second vane (56) and abrasion plate (88), preferably being less than five millimeters, and, more preferably, less than one millimeter, while being preferably greater than one one-hundredth of a millimeter and, more preferably, more than one fiftieth of a millimeter.

Figure 8:
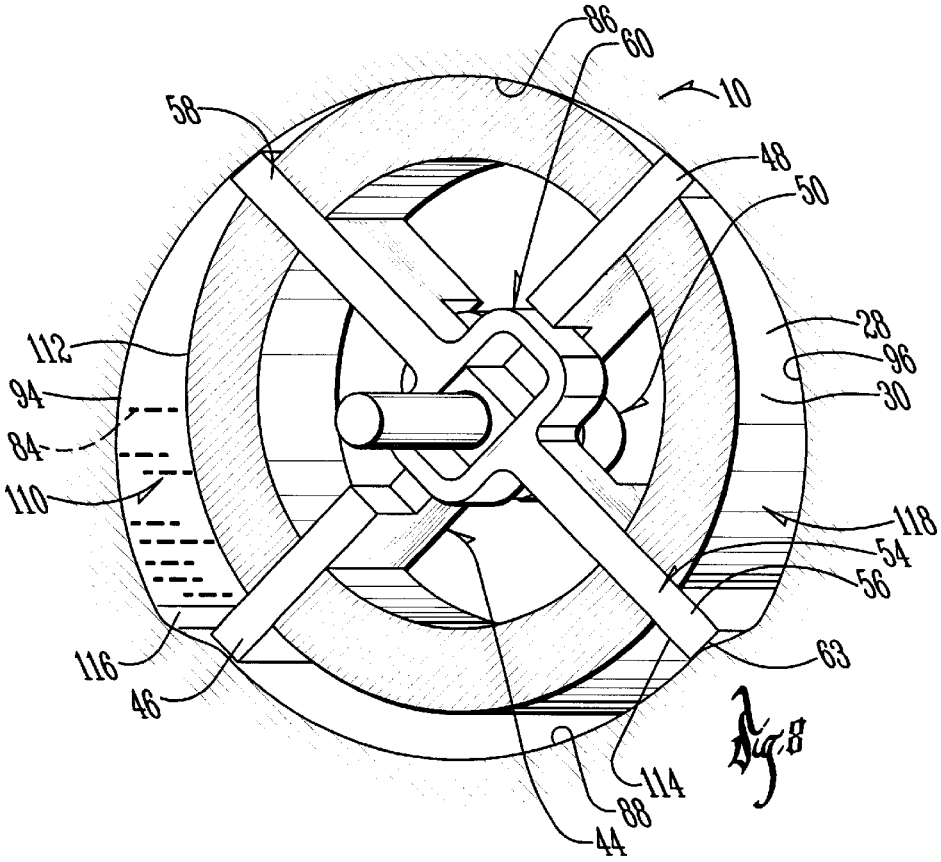
FIG. 8 illustrates a reverse perspective view of the motor of FIG. 7, shown with the vanes rotated into the partially-retracted and partially-extended orientation.

As the pressurized fluid (84) presses against the face (114) of the second vane (56), the second vane (56) rotates the inner drum (28) and the drum shaft (66). As the drum shaft (66) rotates toward the orientation shown in FIG. 7, the second lost motion linkage (60) forces the second vane (56) outward relative to the inner drum (28). This action increases the portion of the second vane (56) exposed to the pressurized fluid (84) and, thereby, increases the drag coefficient of that portion of the second vane (56) exposed to the pressurized fluid (84). As the second vane (56) moves past the orientation shown in FIG. 7 and reaches the end of the abrasion plate (88), the first vane (46) moves over the abrasion plate (88) and the pressurized fluid (84) presses against a face (116) of the first vane (46), thereby continuing the counter clockwise rotation of the drum shaft (66) and the inner drum (28). (FIG. 8).

As the inner drum (28) continues to rotate, the vanes (46), (48), (56) and (58) extend and retract relative to the inner drum (28). (FIG. 8).The retraction reduces the drag coefficient of the vanes (46), (48), (56) and (58), when the vanes are near the ceiling (86), to reduce reverse torque on the inner drum (28). Conversely, the extension increases the drag coefficient of the vanes (46), (48), (56) and (58) as the vanes approach the abrasion plate (88) to allow the pressurized fluid to provide maximum forward torque to the inner drum (28) through the vanes (46), (48), (56) and (58).

As the vanes (46), (48), (56) and (58) move past the abrasion plate (88), the pressurized fluid (84) enters an exhaust chamber (118) defined by the exhaust sidewall (96) and the outer arcuate surface (112) of the inner race (30). (FIG. 7). From the exhaust chamber (118) the pressurized fluid (84) exits the outlet (22), passes through the return hose (106) to the condenser (108) and on to the heating chamber (100) as water (102). (FIGS. 1 and 6). Although the motor (10) may be constructed of any suitable material, in the preferred embodiment, all of the materials are constructed of stainless steel, except for the bushing (16), bearings (72), tips (63), abrasion plate (88), pressure hose (104) and return hose (106), which are constructed from material described herein, or from standard, known materials suitable for their intended purpose. Of course, the motor (10) may be constructed of aluminum, brass, plastic or any other material known in the art. The bushing (16) and bearings (72) may include stainless steel bearings, Teflon® bushings, or any other suitable material known in the art.

The motor (10) may be constructed of any suitable dimensions, from several angstroms to several meters in length. Preferably, the motor (10) is constructed of a block, approximately one cubic centimeter to one cubic meter in size, and, more preferably, twenty-five cubic centimeters to one-half cubic meter in size. In the preferred embodiment, the first vane assembly (44) is 16.510 centimeters long, 7.620 centimeters wide, and 0.953 centimeter thick. The first C-shaped cutout (52) is 3.823 centimeters deep and 7.620 centimeters long, and the first lost motion linkage (50) is provided with an interior space (64) 1.905 centimeters high and 4.128 centimeters wide. The diameter of the outer race (26) is 15.240 centimeters, and the distance between the ceiling (86) and the abrasion plate (88), along a line through a center point defined by the outer race (26) is 16.510 centimeters.

Figure 9:
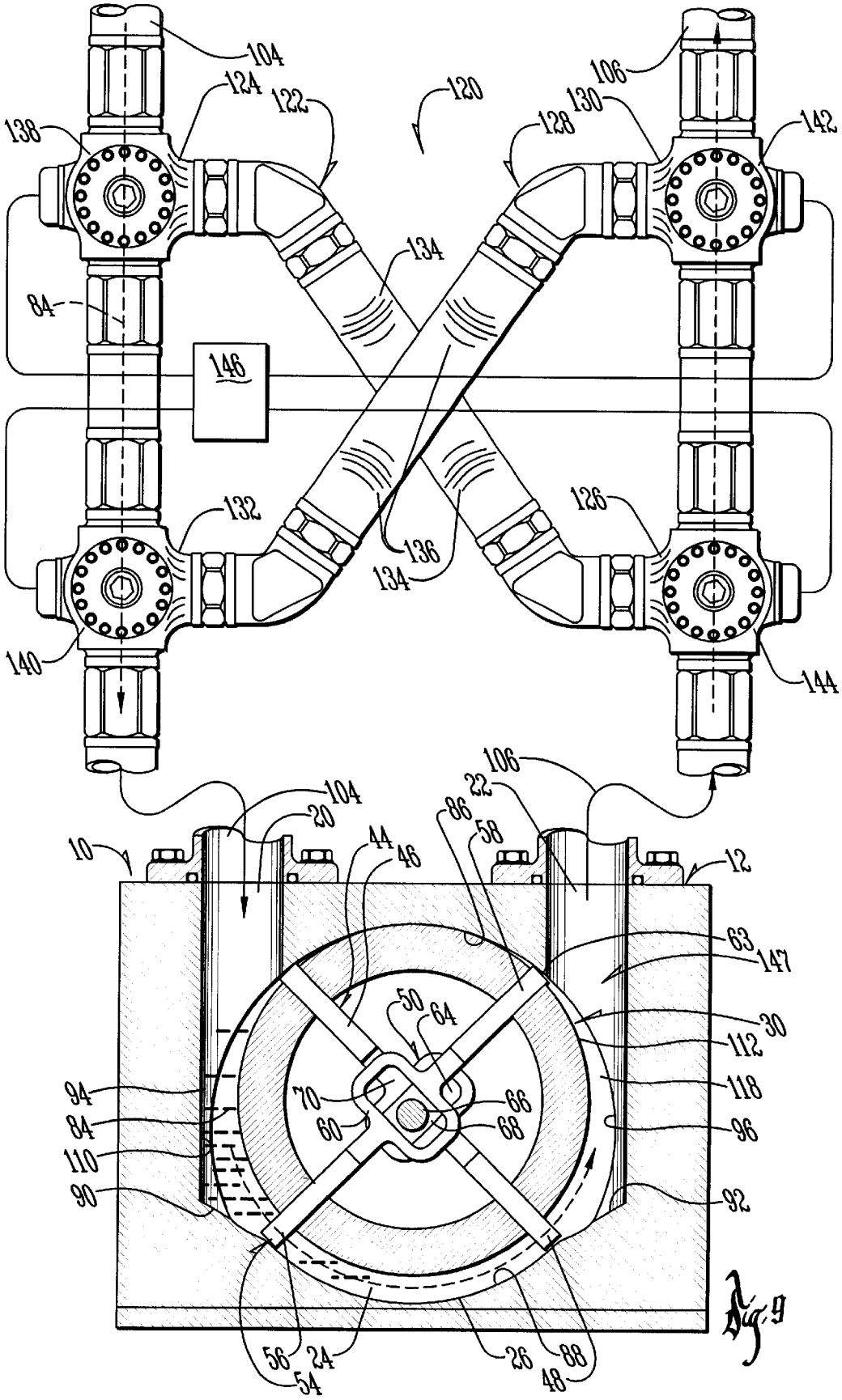
FIG. 9 illustrates a side elevation cross-section of a first alternative embodiment of the motor shown with means for reversing the flow of fluid through the motor.

Shown in FIG. 9 is an alternative embodiment of the present invention incorporating a reverse fluid flow assembly (120). As noted above, the pressure hose (104) is coupled to the inlet (20) of the motor (10) and the return hose (106) is coupled to the outlet (22). In this alternative embodiment, the reverse fluid flow assembly (120) includes a first transfer hose (122) having a first end (124) and a second end (126). A second transfer hose (128) is also provided with a first end (130) and a second end (132).

Because the pressure hose (104) and return hose (106) preferably extend parallel to one another and normal to the motor (10), the first transfer hose (122) is provided with a pair of bends (134). Similarly, the second transfer hose (128) is also provided with a pair of bends (136) to allow the transfer hoses (122) and (128) bend around on another to be secured to the pressure hose (104) and return hose (106) as shown in FIG. 9. It should be noted, of course, that the transfer hoses (122) and (128), while preferably constructed of high pressure hosing material similar to that used to construct the pressure hose (104) and return hose (106), may be constructed of any suitable material, and may be secured to the pressure hose (104) and return hose (106) in any suitable manner or orientation known in the art.

As shown in FIG. 9, the pressure hose (104) is provided with a first valve (138) to alternatively direct pressurized fluid (84) through the pressure hose (104) or first transfer hose (122). The first end (124) of the first transfer hose (122) is coupled to the first valve (138). The first valve (138), in the preferred embodiment, is a standard stainless steel high pressure fluid valve such as those known in the art. Of course, the first valve (138) may be constructed of any suitable material or dimensions. Also in the preferred embodiment, the first end (124) of the first transfer hose (122) and the second end (132) of the second transfer hose (128) are secured to the pressure hose (104) by weldments. Similarly, the first end (130) of the second transfer hose (128) and the second end (126) of the first transfer hose (122) are secured to the return hose (106) by weldments.

As shown in FIG. 9, the pressure hose (104) is also provided with a second valve (140) similar in construction to the first valve (138) described above. As shown, the second valve (140) is secured to the pressure hose (104) at the point at which the second end (132) of the second transfer hose (128) is secured to the pressure hose (104).

Similarly, a third valve (142) is secured to the return hose (106) at the point where the first end (130) of the second transfer hose (128) connects to the return hose (106). A fourth valve (144) is secured to the return hose (106) at the point where the second end (126) of the first transfer hose (122) is coupled to the return hose (106).

Although the valves (138), (140), (142) and (144) may be manually actuated, in the preferred embodiment, the valves (138), (140), (142) and (144) are all electrically coupled to a computer controlled switching system (146), such as those known in the art. When the valves (138), (140), (142) and (144) are oriented as shown in FIG. 9, pressurized fluid (84) passes through the pressure hose (104), through the hollow interior (24), and passes through the outlet (22) and through the return hose (106) in a generally U-shaped path (147). One advantage of the generally U-shaped path (147) is its symmetry. Additionally, the U-shaped path (147) reduces the number of bends the pressurized fluid (84) must take through the motor (10), thereby reducing friction and increasing the available energy of the pressurized fluid (84) to be transferred to the motor (10).

Figure 10:
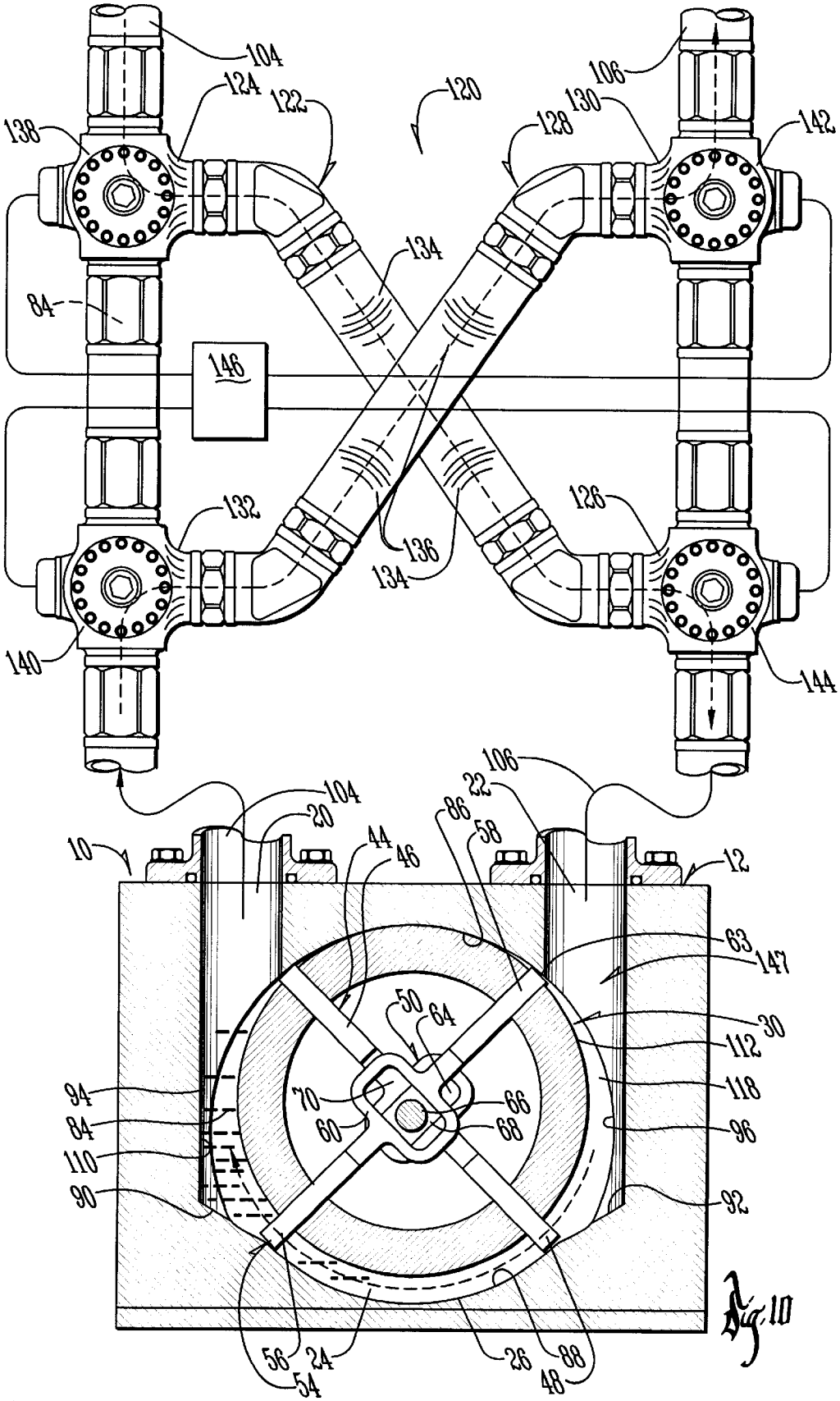
FIG. 10 illustrates the motor of FIG. 9, shown with the gates actuated to reverse the flow of fluid through the motor.

As shown in FIG. 10, when the computer controlled switching system (146) is actuated to reverse the valves (138), (140), (142) and (144), the pressurized fluid (84) does not flow from the pressure hose (104) through the inlet (20) of the motor (10), but instead flows through the first valve (138), through the first transfer hose (122), through the fourth valve (144) and through the outlet (22). The pressurized fluid continues through the hollow interior (24) of the motor (10) to exit the motor (10) through the inlet (20). From the inlet (20) the pressurized fluid (84) passes through the second valve (140), through the second transfer hose (128), through the third valve (142), and into the return hose (106). Accordingly, when the computer controlled switching system (146) reverses the valves (138), (140), (142) and (144), the pressurized fluid (84) rotates the vanes (46), (48), (56) and (58) and the inner drum (28) in a reverse direction, thereby generating reverse torque on the inner drum (28). Accordingly, the motor (10) may be utilized without a separate clutch and reverse gear assembly to reverse its rotational motion.

Figure 11:
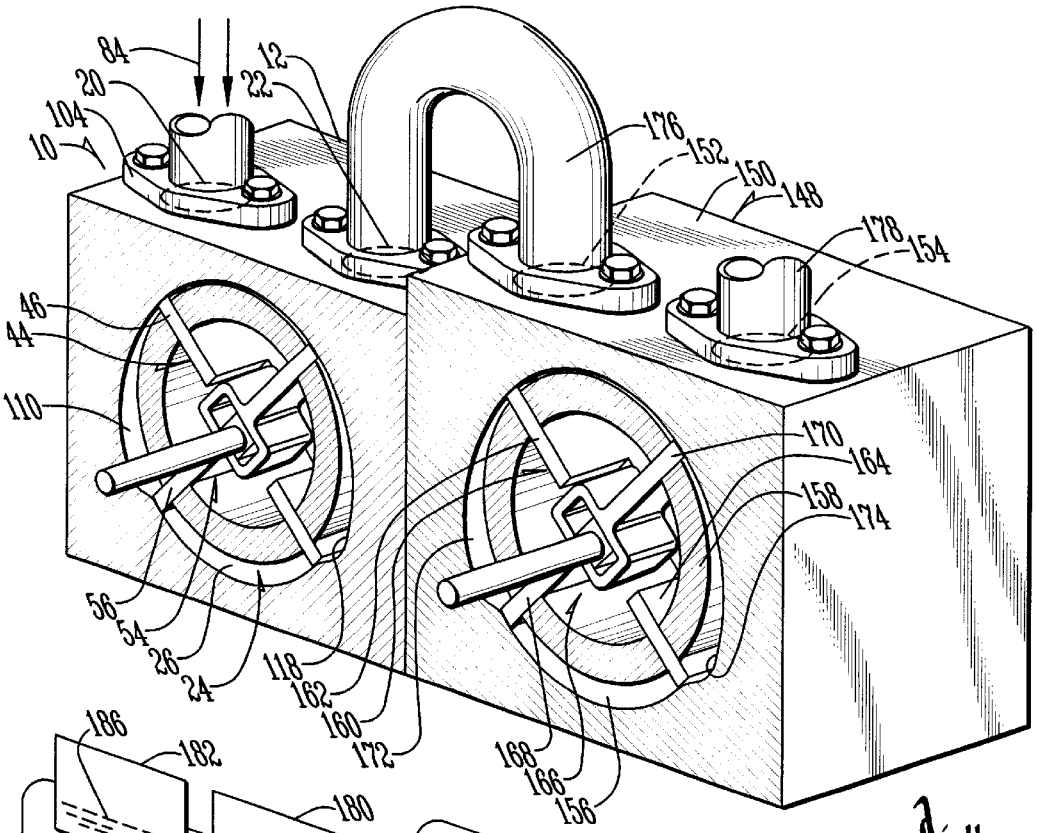
FIG. 11 illustrates a rear perspective view of a second alternative embodiment of a two-stage motor of the present invention, shown with the rear of the cases and the shaft bushings removed.
Figure 12:
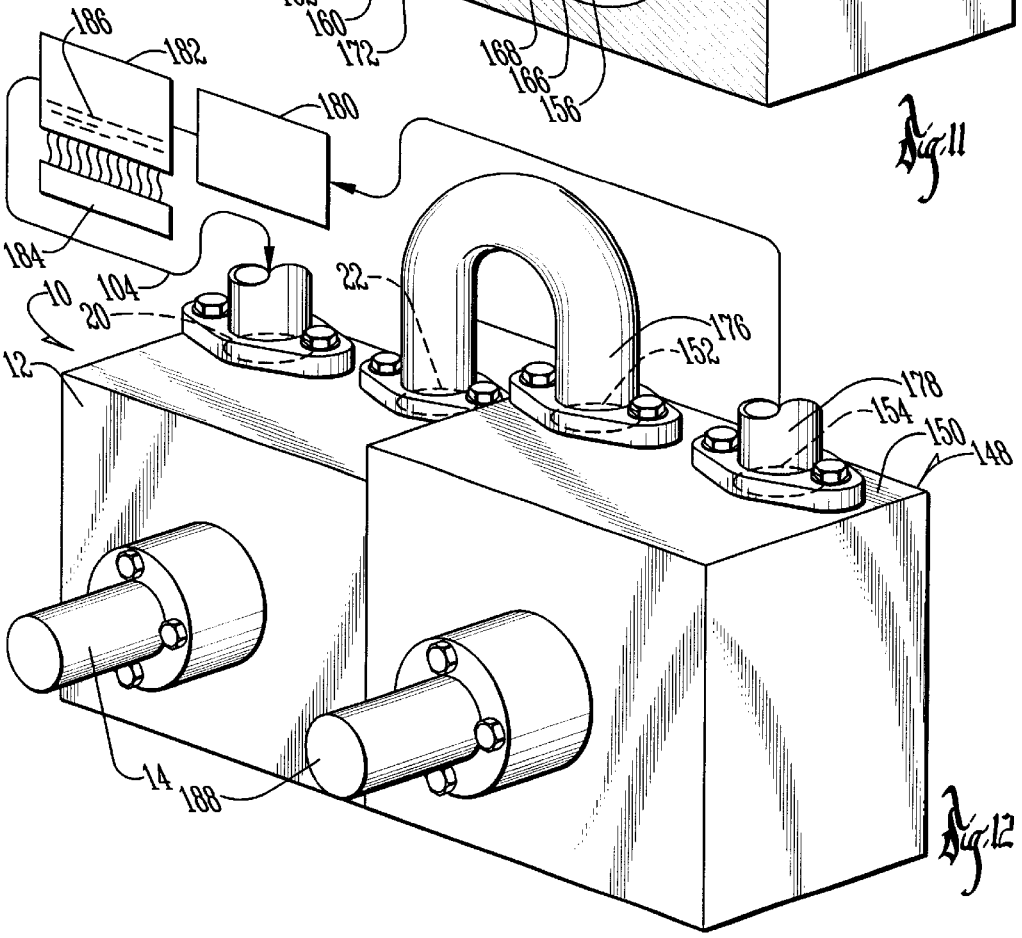
FIG. 12 illustrates a front perspective view of the second alternative embodiment of FIG. 11.

Yet another alternative embodiment of the present invention is shown in FIGS. 11–12. As shown in FIG. 11, the motor (10) of the present invention is coupled to an auxiliary motor (148) similar, but slightly larger than the motor (10). Although the dimensions of the auxiliary motor (148) may be increased or decreased to any suitable dimensions, the dimensions of the auxiliary motor (148) are preferably increased between five and fifty percent over the dimensions of the motor (10), more preferably increased ten to twenty percent over the dimensions of the motor (10), and most preferably increased fifteen en percent over the dimensions of th e motor (10).

As shown in FIG. 11, the auxiliary motor (148) is provided with a casing (150) an inlet (152), an outlet (154), a hollow interior (156) and an inner drum (158). The auxiliary motor (148) is also provided with a first vane assembly (160), including a first vane (162) and a third vane (164), as well as a second vane assembly (166) including a second vane (168) and a fourth vane (170). The casing (150) is constructed with an inlet chamber (172) and an exhaust chamber (174) such as that described above in reference to the motor (10).

As shown in FIG. 11, the pressure hose (104) is coupled to the inlet (20) of the motor (10), but the outlet (22) is coupled to a transfer hose (176). Whereas one end of the transfer hose (176) is coupled to the outlet (22) of the motor (10), the other end of the transfer hose (176) is coupled to the inlet (152) of the auxiliary motor (148). An auxiliary return hose (178) is coupled to the outlet (154) of the auxiliary motor (148).

In operation, pressurized fluid (84) is supplied to the pressure hose (104) to the inlet (20) of the motor (10). The pressurized fluid (84) passes through the inlet chamber (110), through the hollow interior (24) of the motor (10), and through the exhaust chamber (118). From the exhaust chamber (118), the pressurized fluid (84) exits through the outlet (22), through the transfer hose (176), and into the inlet (152) of the auxiliary motor (148). From the inlet (152), the pressurized fluid (84) passes into the inlet chamber (172) of the auxiliary motor (148), through the hollow interior (156), and into the exhaust chamber (174) From the exhaust chamber (174), the pressurized fluid (84) exits through the outlet (154) into the auxiliary return hose (178).

As shown in FIG. 12, the auxiliary return hose (178) is coupled to a condenser (180) and heating chamber (182). The heating chamber (182) is preferably used in conjunction with a heater (184) used to heat a fluid (186) within the heating chamber (182). As shown in FIGS. 11 and 12, the motor (10) and auxiliary motor (148) are used in conjunction to drive two drive shafts (14) and (188) with a single cycle of pressurized fluid (84). Pressurized fluids (84) such as steam often would not fully expand being passed through the motor (10). The auxiliary motor (148) allows for greater expansion of the pressurized fluid (84) and, in turn, greater recovery of work from such expansion in the form of rotation of the drive shaft (188). It should be noted that any number and combination of motors (10) and (148) may be used to obtain the benefits of the present invention.

Figure 13:
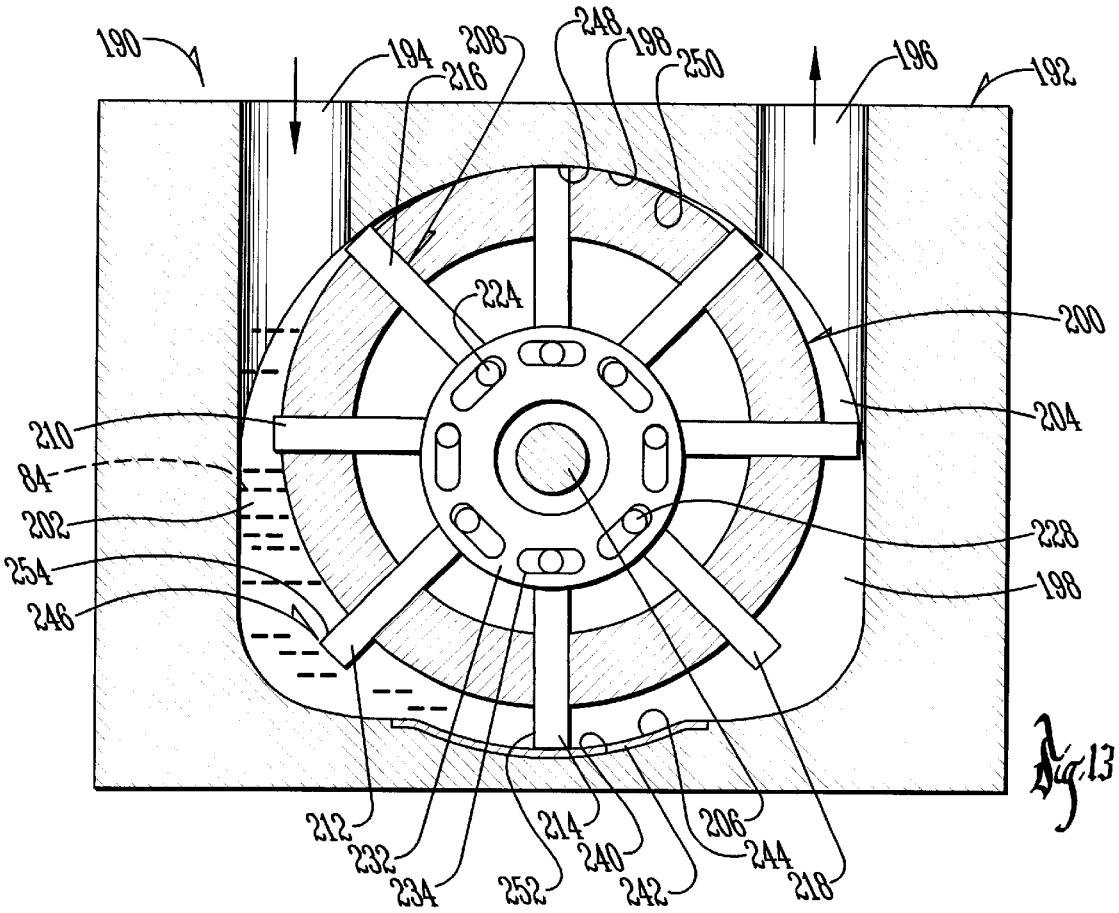
FIG. 13 illustrates a rear elevation cross-section of a third alternative embodiment of the present invention.
Figure 14:
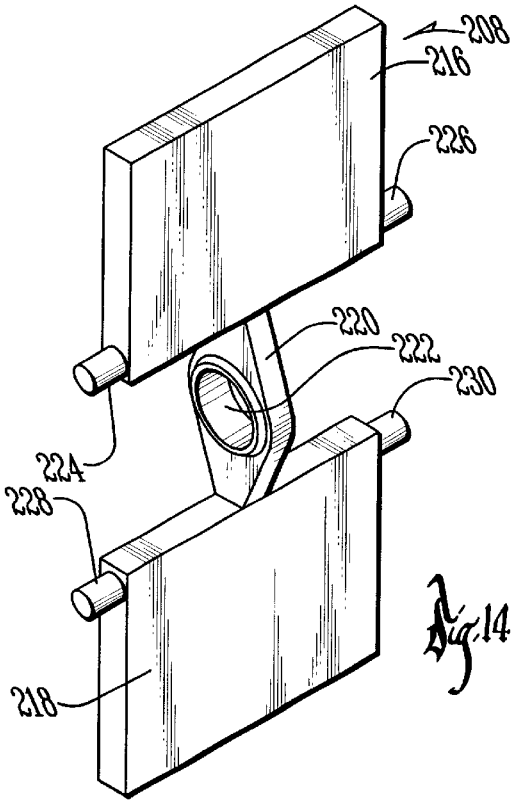
FIG. 14 illustrates a front perspective view of a vane assembly of the third alternative embodiment of the present invention shown in FIG. 13.
Figure 15:
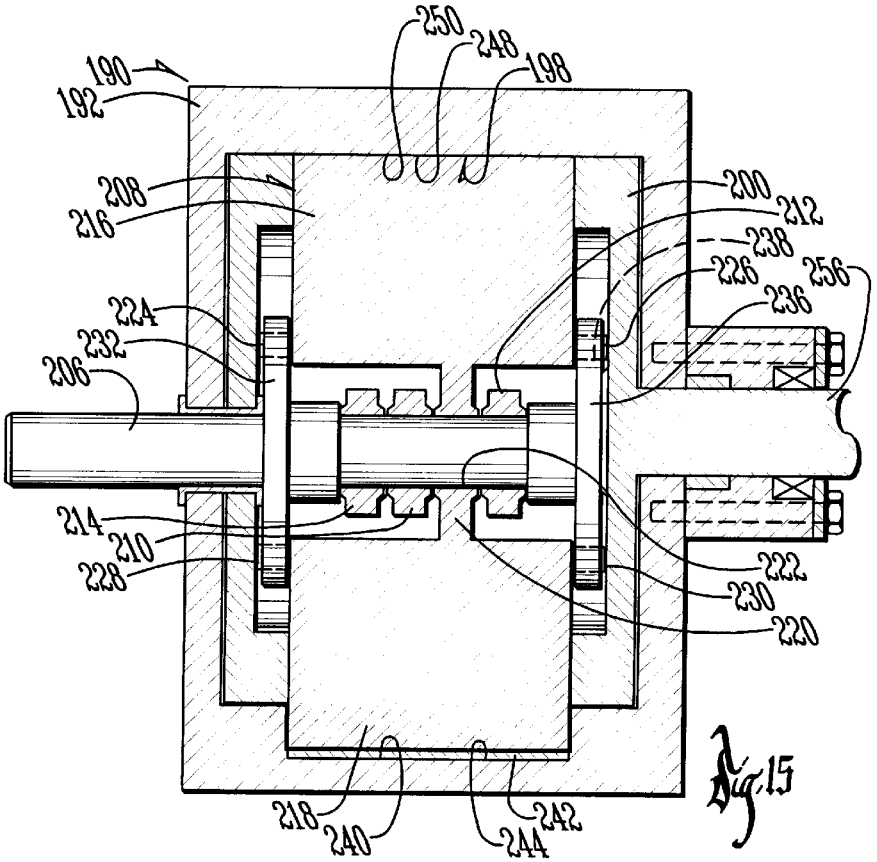
FIG. 15 illustrates a side elevation cross-section of the third alternative embodiment of the present invention, taken along line 15—15 of FIG. 13.

Another alternative embodiment of the present invention is shown in FIGS. 13–15. In this embodiment of the present invention, a motor (190) includes a casing (192), an inlet (194), an outlet (196), a hollow interior (198), and an inner drum (200). The inner drum (200), along with the casing (192), defines an inlet chamber (202) and an exhaust chamber (204). A drum shaft (206) is provided within the inner drum (200), around which is provided a first vane assembly (208), a second vane assembly (210), a third vane assembly (212), and a fourth vane assembly (214). Due to the similarity of the vane assemblies (208), (210), (212) and (214), description will be limited to the first vane assembly (208).

The first vane assembly (208) is provided with a first vane (216) and a second vane (218). As shown in FIG. 14, the first vane assembly (208) is provided with a bridge (220), coupling the first vane (216) to the second vane (218). The bridge (220) is provided with an opening (222) through which extends the drum shaft (206). FIGS. 13 and 14. Although the bridge (220) may be secured to the first vane (216) and second vane (218) by weldments, in the preferred embodiment, the first vane assembly (208) is preferably tooled from a single block of stainless steel.

Although the bridge (220) of the first vane assembly (208) is provided near the center of the vanes (216) and (218), in the second vane assembly (210), third vane assembly (212), and fourth vane assembly (214), the respective bridges are offset to either side, so that all of the vane assemblies (208), (210), (212) and (214) may be provided around the drum shaft (206). If desired, a plurality of bridges (220) may be secured between the first vane (216) and second vane (218) to provide more positive support between the two vanes (216) and (218). Similarly, although four vane assemblies (208), (210), (212) and (214) are shown, any desired number of vane assemblies may be provided around the drum shaft (206).

As shown in FIG. 14, the first vane assembly (208) is provided with a first ear (224) and a second ear (226). Similarly, a third ear (228) and fourth ear (230) are secured to the second vane (218). As shown in FIG. 13, the motor (190) is provided with a first guide plate (232), provided with a plurality of slots (234). The slots (234) are preferably slightly wider than the diameter of the ears (224), (226), (228) and (230), and are sufficiently long to accommodate movement of the ears (224), (226), (228) and (230) as the inner drum (200) rotates (FIGS. 13–14). As the vane assemblies (208), (210), (212) and (214), and the motor (190) may be constructed of any suitable dimensions, the length of the slots (234) vary in accordance therewith. As shown in FIG. 15, a second guide plate (236) is provided with slots (238) having dimensions similar to the first guide plate (232).

As shown in FIG. 13, the casing (192) defines a drive race (240) in the form of an arcuate surface. Secured over the drive race (240) is an abrasion plate (242) secured by tension to the casing (192) in a manner similar to that described above in relation to the abrasion plate (88) provided on the motor (10). Unlike the abrasion plate (88) described above, however, the abrasion plate (242) associated with the motor (190) is much smaller. The concave portion (244) of the abrasion plate (242) is of the same length as the distance between the midpoints of the ends (246) of two of the vane assemblies (208), (210), (212) or (214) when the two vane assemblies (208), (210), (212) or (214) are positioned symmetrically over the abrasion plate (242). Accordingly, the more vane assemblies provided, the shorter the abrasion plate (242). The casing (192) is also provided with a ceiling (248) having a concave surface (250) having a flatter curvature than the curvature of the inner drum (200) and, preferably, of a curvature defining part of a circle having its midpoint at the axis upon which the drum shaft (206) rotates.

As shown in FIG. 13, when pressurized fluid (84) is provided into the inlet (194), the pressurized fluid (84) pushes against a face (252) of the fourth vane assembly (214), thereby rotating the inner drum (200) in a counterclockwise direction. As the inner drum (200) rotates, the third vane assembly (212) moves into position directly above the concave portion (244) of the abrasion plate (242), and the pressurized fluid (84) presses against a face (254) of the third vane assembly (212), thereby continuing to rotate the inner drum (200) in a counterclockwise direction.

As shown in FIGS. 13 and 15, as the inner drum (200) rotates, the guide plates (232) and (236) force the vanes (216) and (218) into the inner drum (200) as the vanes (216) and (218) pass near the concave surface (250) of the ceiling (248) and extend the vanes (216) and (218) out of the inner drum (200) as the vanes (216) and (218) pass by the concave portion (244) of the abrasion plate (242). The vanes (216) and (218) cycle through a full extension and retraction for each revolution of the inner drum (200). As shown in FIG. 13, the guide plates (234) and (238) force the ears (224), (226), (228) and (230) of the vane assemblies (208), (210), (212) and (214) from one end of the slots (234) and (238) to the center of the slots (234) and (238) when the vanes (216) and (218) rotate toward the concave surface (250) of the ceiling (248) or toward the concave portion of the abrasion plate (242), before cycling the ears (224), (226), (228) and (230) to the opposite end of the slots (234) and (238) and back to the center of the slots (234) and (238). As shown in FIG. 15, as the inner drum (200) rotates, torque is transferred to a drive shaft (256) secured by weldments or similar securement means to the inner drum (200). The drive shaft (256) may, in turn, be used for any use requiring rotational drive.

Figure 16:
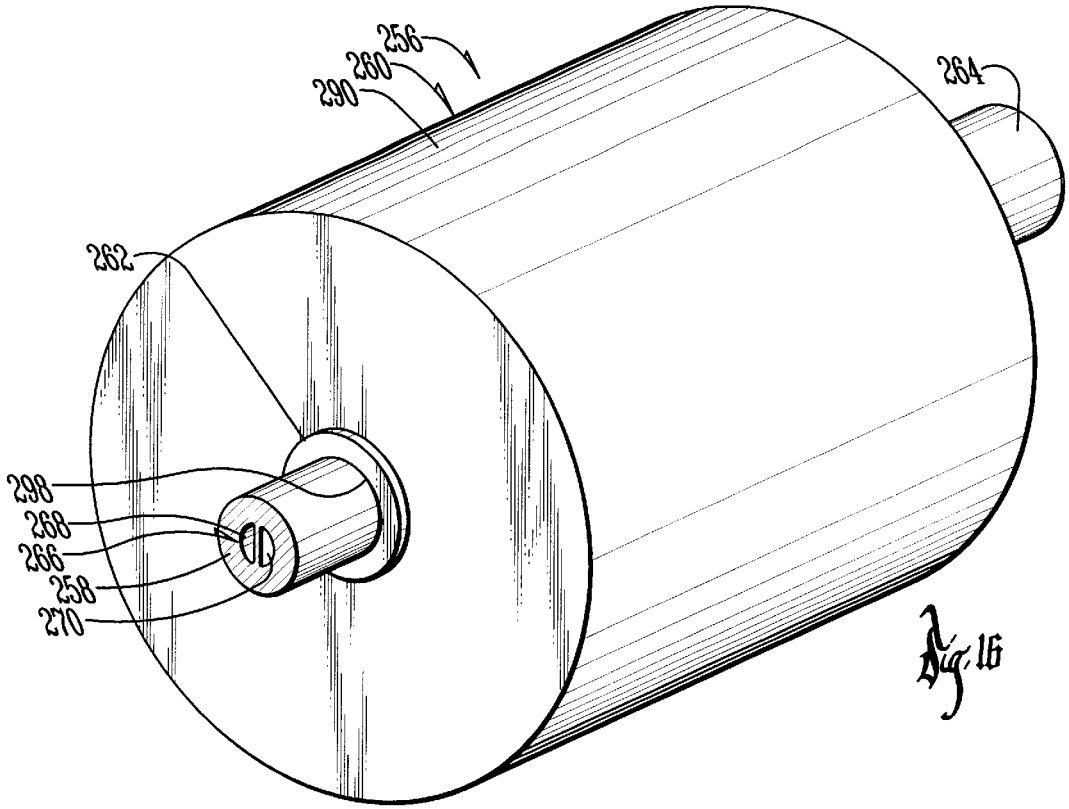
Figure 17:
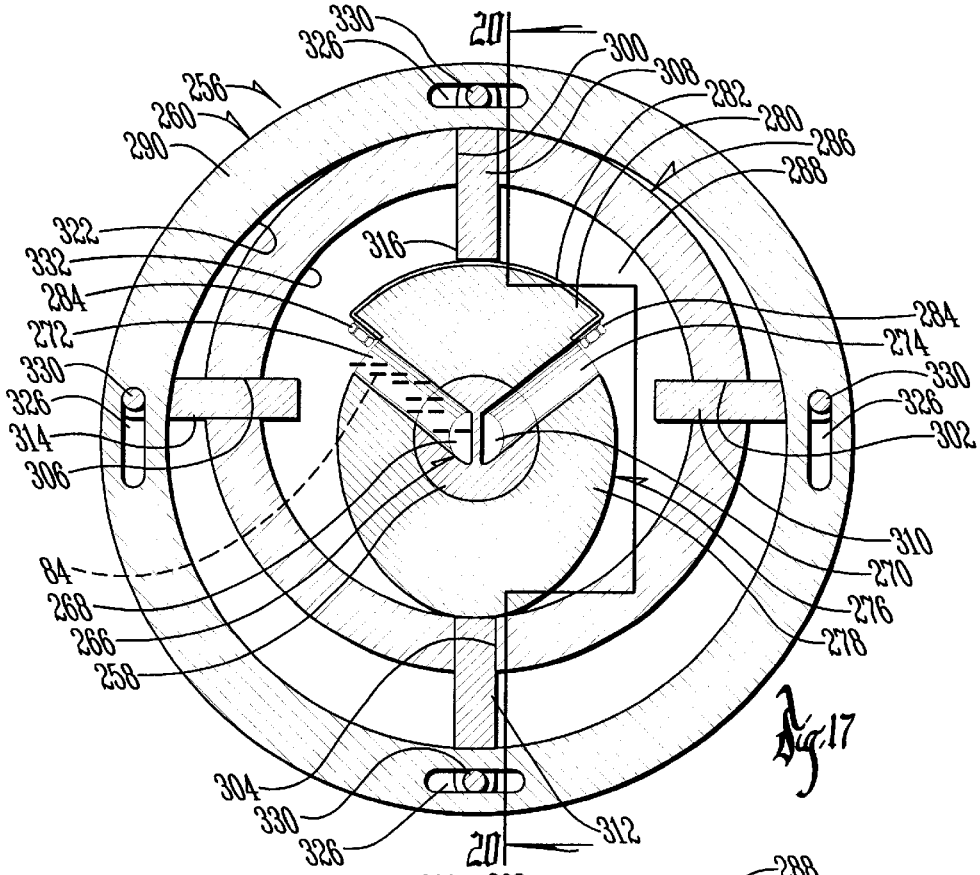
FIG. 17 illustrates a rear elevation cross-section of the fourth alternative embodiment shown in FIG. 16.
Figure 18:
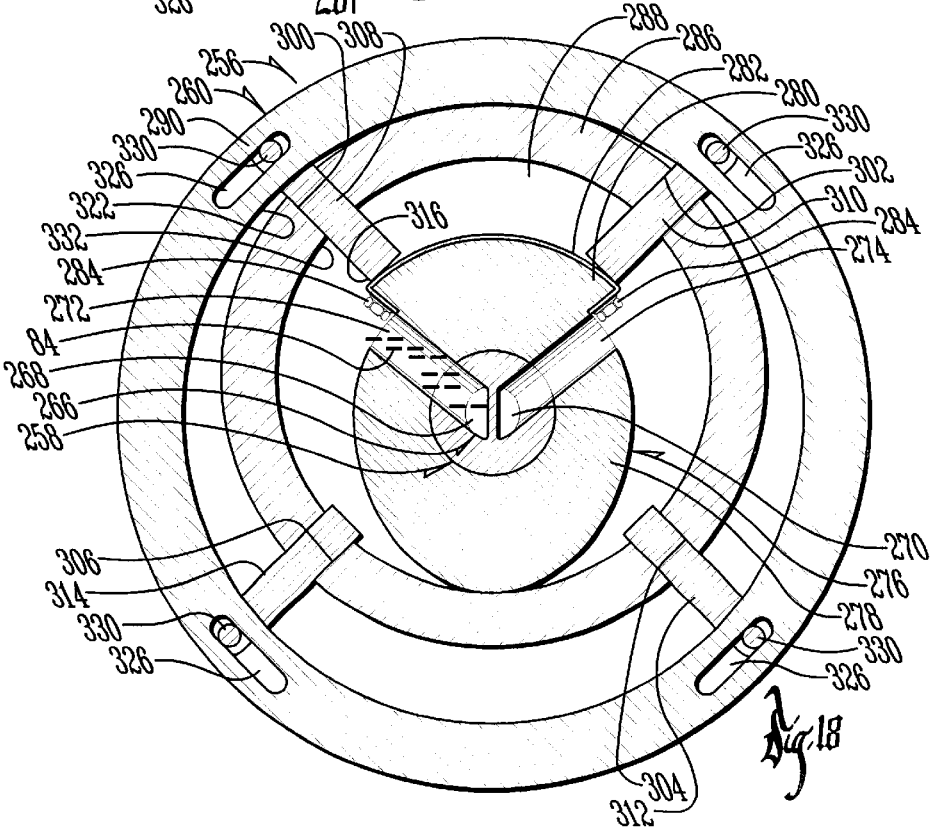
FIG. 18 illustrates the fourth alternative embodiment of the motor of FIG. 16, shown with the vanes rotated 45 degrees.
Figure 19:
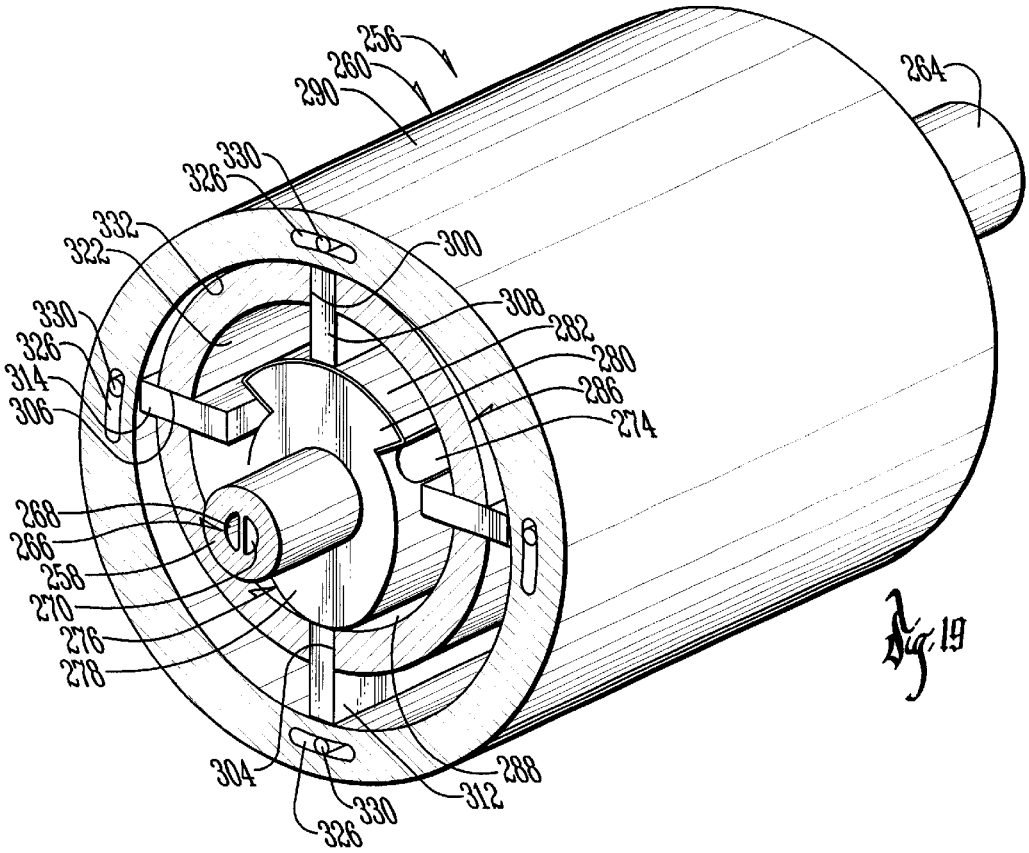
FIG. 19 illustrates a rear perspective view of the fourth alternative embodiment of the present invention shown in FIG. 16.

Another alternative embodiment of the present invention is shown in FIGS. 16–21. As shown in FIG. 16, the alternative motor (256) includes a support shaft (258) and an outer drum (260) rotatably secured to the support shaft (258) by a bearing assembly (262). Extending from the outer drum (260) is a drive shaft (264). As shown in FIG. 16, the support shaft (258) is provided with a hollow interior (266) divided into a pressure tube (268) and a return tube (270). As shown in FIG. 17, the pressure tube (268) is in fluid communication with an inlet (272) and the return tube (270) is in fluid communication with an outlet (274). As shown in FIG. 19, the support shaft (258) extends into and is secured to a base block (276) tooled from a solid block of stainless steel. The support shaft (258) is preferably welded or otherwise secured to the base block (276) to prevent rotation of the base block (276) relative to the support shaft (258). As shown in the drawings, the outlet (274) is a long, narrow slot provided in the base block (276). The inlet (272) is a similar long, narrow slot provided on the opposite side of the base block (276) from the outlet (274) (FIGS. 17 and 19). Of course, it should be noted that the inlet (272) and outlet (274) may be of any suitable dimensions. As shown in FIG. 17, the base block (258) includes a cylindrical block portion (278) and a race portion (280). An abrasion plate (282) constructed of titanium or similar abrasion resistant material is secured over the race portion (280) of the base block (276) by bolts (284), or similar securement means known in the art.

Figure 21:
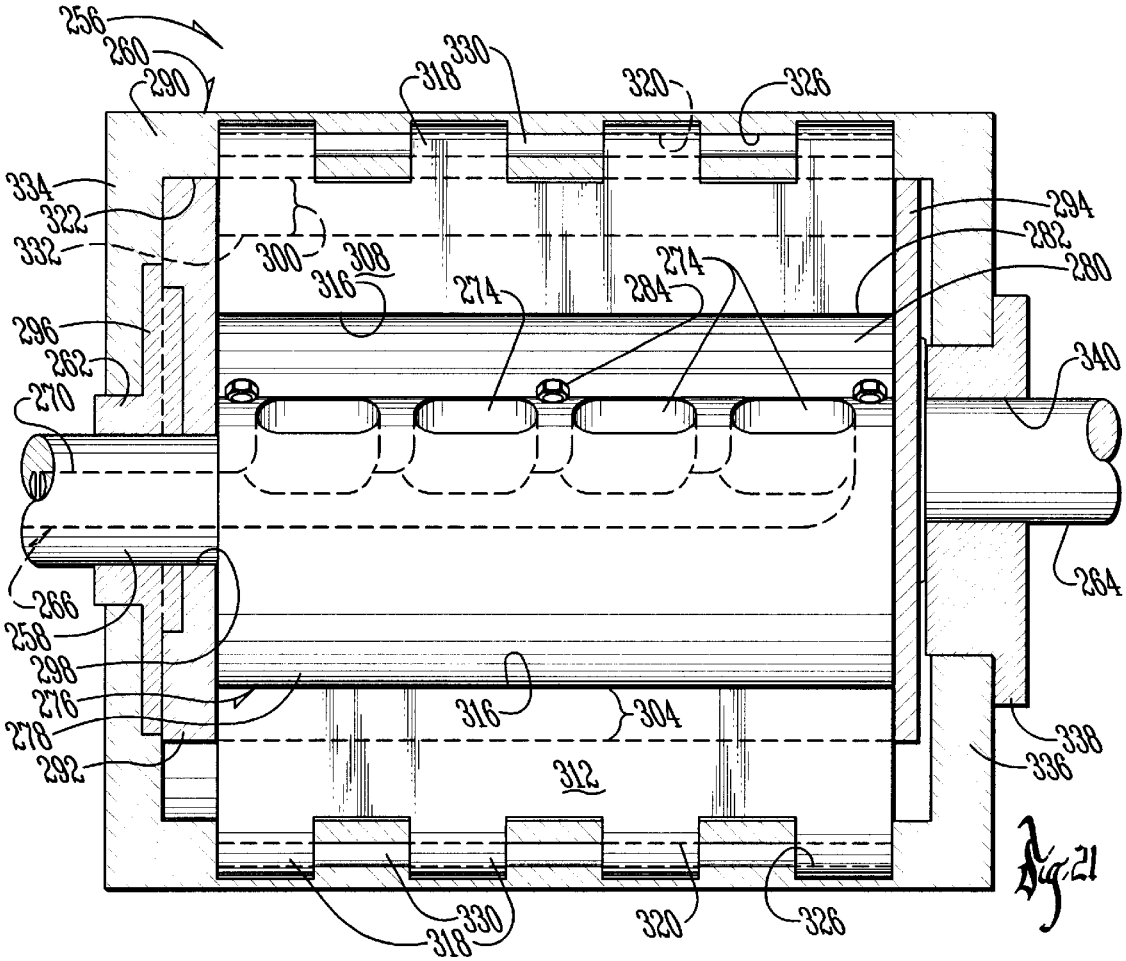
FIG. 21 illustrates a side elevation cross-section of the fourth alternative embodiment of the present invention, taken along line 20—20 of FIG. 17.

As shown in FIG. 17, an inner drum (286) having an interior (288) is provided around the base block (276). As shown in FIG. 21, the inner drum (286) is provided with a cylinder (290), a head plate (292) and a foot plate (294). The bearing (262) is secured to both the outer drum (260) and the head plate (292). As shown in FIG. 21, the bearing assembly (262) is provided with a freewheeling center plug (296) having an aperture (298) of a size only slightly larger than the support shaft (258). As shown in FIG. 21, the aperture (298) is positioned near the perimeter of the center plug (296) to allow the inner drum (286) to rotate in relationship to the support shaft (258) while maintaining a substantially fluid tight seal within the inner drum (286).

As shown in FIG. 17, the inner drum (286) is provided with a first aperture (300), a second aperture (302), a third aperture (304) and a fourth aperture (306). Extending through the apertures (300), (302), (304) and (306) are a first vane (308), a second vane (310), a third vane (312) and a fourth vane (314). The vanes (308), (310), (312) and (314) may be constructed of any desired dimensions. As the vanes (308), (310), (312) and (314) are substantially similar in construction, description will be limited to that of the vane (308).

Figure 20:
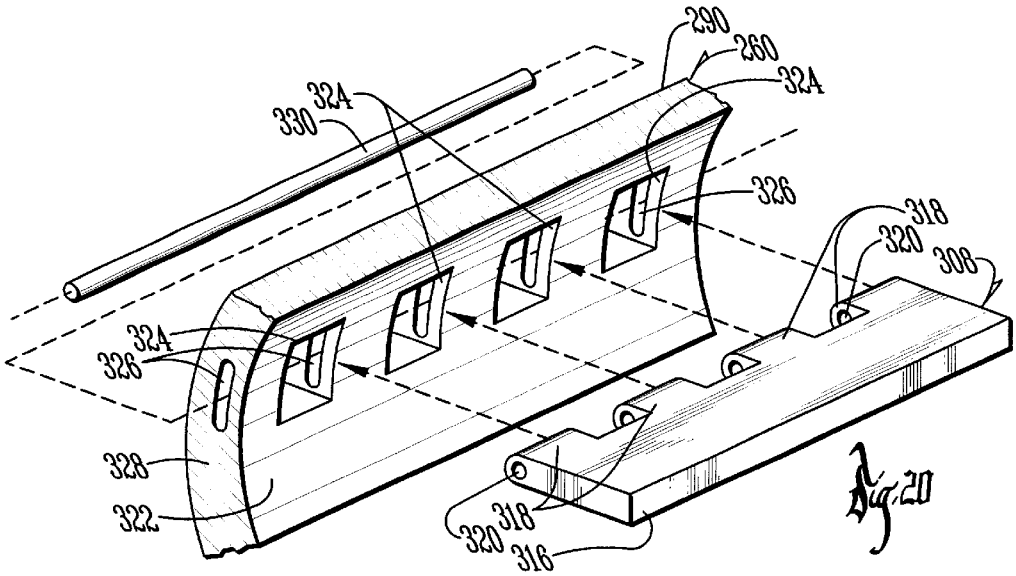
FIG. 20 illustrates an exploded view in partial cutaway of a section of the outer drum and vane of the fourth alternative embodiment shown in FIG. 16.

As shown in FIG. 20, the first vane (308) is provided with an end (316) and a plurality of ears (318). Each of the ears (318) is provided with a bore (320). The outer drum (260) is provided with an inner face (322) on which is provided a plurality of rectangular slots (324), all of which are cut deeply enough to communicate with a curved slot (326) provided in a wall (328) of the outer drum (260). The slots (324) are sized to accommodate the ears (318) provided on the first vane (308). The ears (318) are provided in the slots (324) and a steel rod (330) is fitted through the curved slot (326) and through the bores (320) provided in the ears (318) of the vane (308). This assembly allows the vane (308) to slide relative to the inner face (322) of the outer drum (260). As shown in FIG. 17, the inner drum (286) and outer drum (260) are centered upon axes which are parallel but distanced from one another. Accordingly, as the inner drum (286) moves through one revolution, the ears (318) slide from one end of the slots (326) to the center of the slots (326), to the other end of the slots (326), back to the center of the slots (326), and return to the starting point.

As shown in FIG. 17, the inner drum (286) and outer drum (260) are arranged relative to one another in a manner in which the inner drum (286) is positioned nearly in contact with the inner face (322) of the outer drum (260). Accordingly, when the first vane (308) is at the point where the inner drum (286) is closest to the inner face (322) of the outer drum (260), the vane (308) reaches its maximum extension into the interior (288) of the inner drum (286). Conversely, when the vane (308) is at the point where the inner drum (286) is furthest from the outer drum (260), the end (316) of the vane (308) is retracted out of the interior (288) of the inner drum (286) to the point where the end (316) of the vane (308) is flush with an interior face (332) of the inner drum (286).

To operate the motor (256), pressurized fluid (84) is provided through the pressure tube (268) and out of the inlet (272). When the vanes are oriented as shown in FIG. 17, the pressurized fluid (84) presses against the first vane (308) which, in turn, rotates both the inner drum (286) and outer drum (260) in a clockwise direction until the motor (256) is in the orientation shown in FIG. 18. Once the fourth vane (314) reaches the edge of the abrasion plate (282), pressurized fluid (84) entering the interior (288) of the inner drum (286) through the inlet (272) begins to press against the fourth vane (314) and continue to rotate both the inner drum (286) and outer drum (260) in clockwise direction. The race portion (280) of the base block (276) is preferably constructed with a curvature similar to the path defined by the end (316) of the vane (308) as it rotates past the base block (276). The end (316) of the base block (276) is provided with a curvature opposite the curvature of the race portion (280) of the base block (276). The race portion (280) can be constructed to be of any distance from the end (316) of the vanes (308), (310), (312) and (314), but is preferably positioned one one-hundredth of a millimeter to five millimeters from the vanes (308), (310), (312) and (314) and, more preferably, between about one tenth of a millimeter to two millimeters from the vanes (308), (310), (312) and (314). The length of the race portion (280) of the base block (276) is preferably about the same distance between the center of the ends (316) of the first vane (308) and fourth vane (314) when the vanes (308) and (314) are positioned symmetrically over the race portion (280) of the base block (276).

As shown in FIG. 18, as the pressurized fluid (84) begins to push against the fourth vane (314), the pressurized fluid between the fourth vane (314) and first vane (308) clears the race portion (280) of the base block (276) and exits the interior (288) of the inner drum (286) through the outlet (274). The pressurized fluid continues out through the return tube (270).

As shown in FIG. 21, the outer drum (260) is provided with a head plate (334) and a foot plate (336). Like the head plate (334), the foot plate (336) is provided with a bushing assembly (338), having an aperture (340) near its perimeter to accommodate the drive shaft (264) welded or otherwise secured to the foot plate (294) of the inner drum (286). Accordingly, as pressurized fluid (84) is injected into the motor (256) through the pressure tube (268), the inner drum (286) and outer drum (260) are rotated by the vanes (308), (310), (312) and (314), which generates rotation of the drive shaft (264). (FIGS. 17 and 21).

Figure 22:
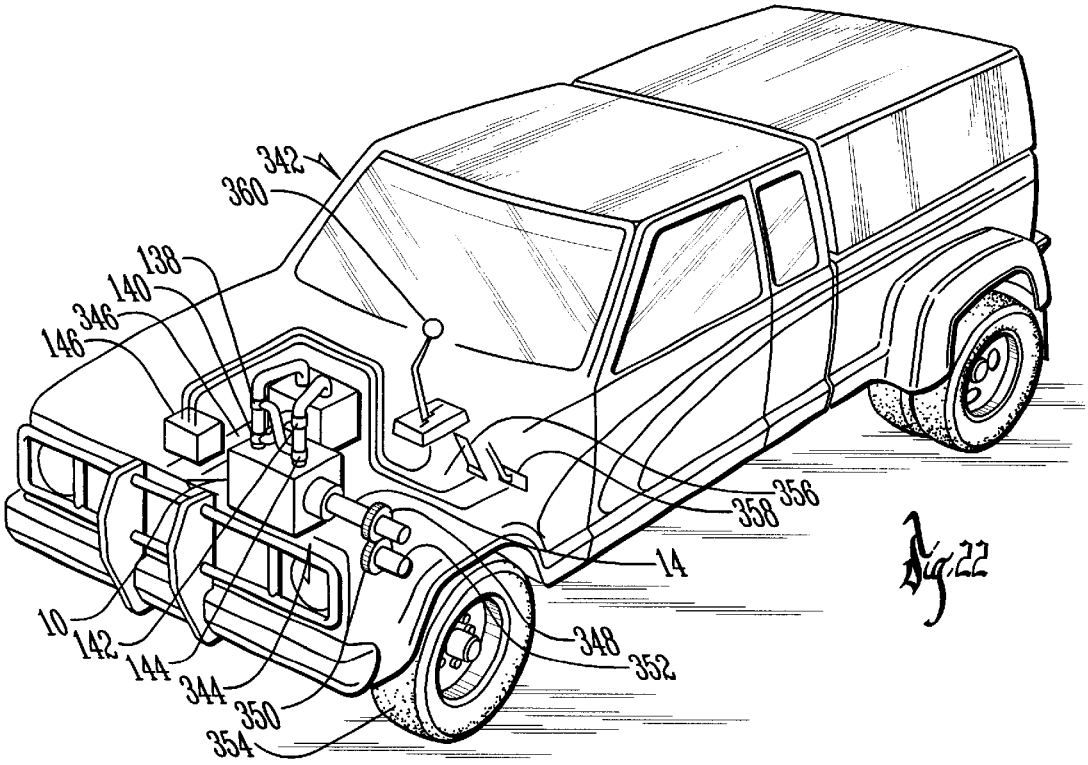
FIG. 22 illustrates a side perspective view in partial cutaway of a truck incorporating the motor of the present invention.

As shown in FIG. 22, the motor (10) is used in association with a motor vehicle (342). The motor (10) is preferably positioned within the engine compartment (344) and secured to the frame (346) of the motor vehicle (342) by bolts (not shown) or by any manner such as those well known in the art. As shown, the drive shaft (14) is provided with a gear (348) operably coupled to another gear (350) secured to an axle (352). The axle (352), in turn, is connected to a pair of wheels (354) used to motivate the motor vehicle (342).

One advantage of the motor (10) of the present invention is the efficient production of torque over a wide range of speeds. Accordingly, there is no need for a transmission such as that used in the prior art. Similarly, the computer controlled switching system (146) coupled to the valves (138), (140), (142) and (144) eliminates the need for a reverse gear such as that used in the prior art. By eliminating the transmission and reverse gear, wear and maintenance of these parts is eliminated.

Figure 23:
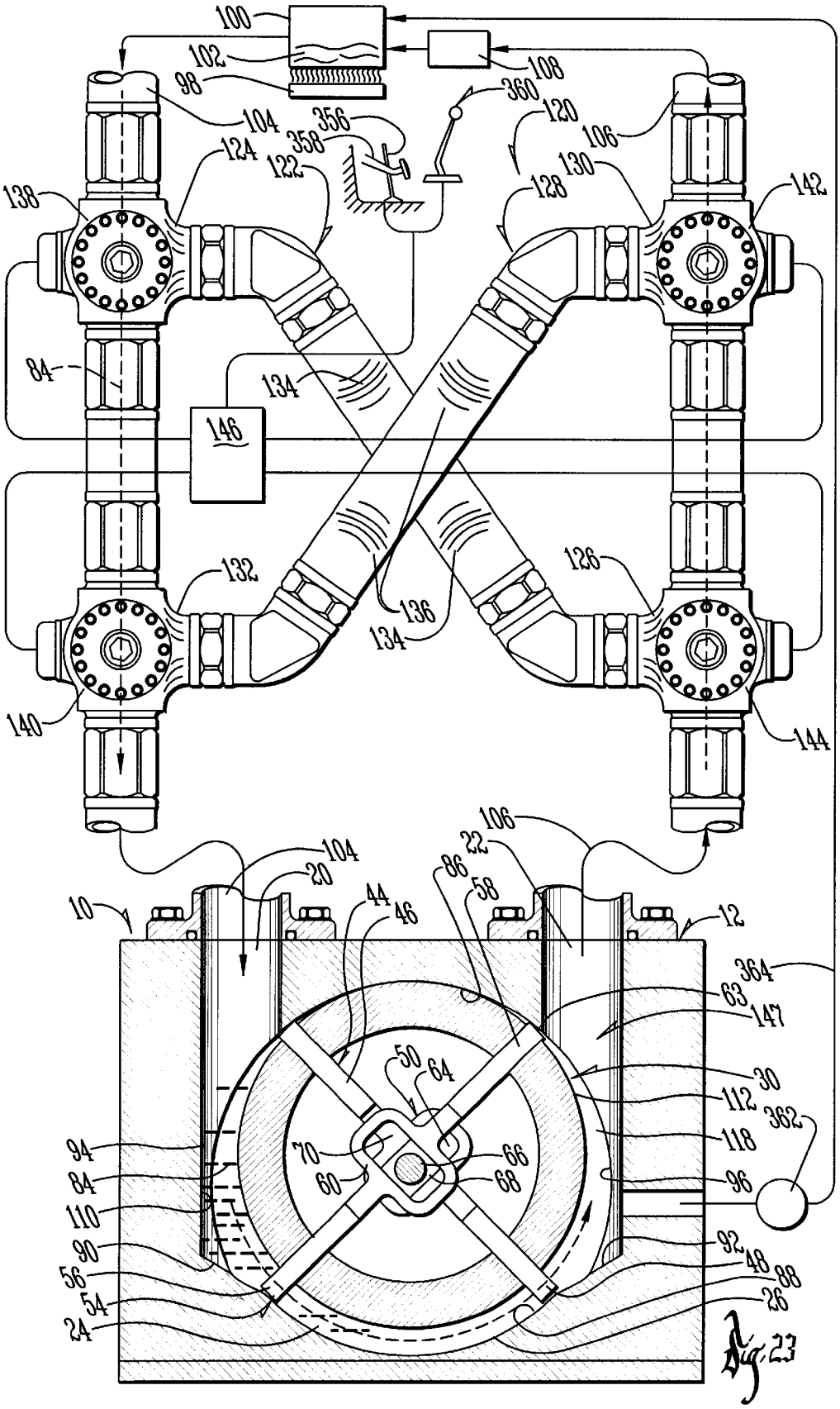
FIG. 23 illustrates a rear elevation cross-section of the motor and control system of FIG. 22.

As shown in FIG. 22, the motor vehicle (342) is provided with an accelerator (356), a brake (358) and a reverse lever (360). As shown in FIG. 23, the accelerator (356), brake (358), and reverse lever (360) are all electrically coupled to the computer controlled switching system (146). Of course, the accelerator (356), brake (358) and reverse lever (360) may be hydraulically, pneumatically or otherwise coupled to the computer controlled switching system 146). In operation, when it is desired to motivate the motor vehicle (342), a user depresses the accelerator (356) which signals the computer controlled switching system (146) to actuate the valves (138), (140), (142) and (144) to allow pressurized fluid (84) to flow through the pressure hose (104), through the inlet (20), rotate the vanes (46), (48), (56) and (58), and exit through the outlet (22) through the return hose (106) and return to the condenser (108) and heating chamber (100), where the water (102) is reheated by the heater (98). (FIGS. 22–23). When it is desired to slow the motor vehicle (342), the brake (358) is depressed, thereby signaling the computer controlled switching system (146) to close valves (140) and (144). With the valves (140) and (144) closed, the wheels (354) of the motor vehicle (342) continue to rotate the axle (352), the gear (350), the gear (348), the drive shaft (14), and the vanes (46), (48), (56) and (58). As the vanes (46), (48), (56) and (58) continue to rotate, they continue to motivate and compress the pressurized fluid (84) contained within the hollow interior (24) of the motor (10) within the exhaust chamber (118). As the vanes (46), (48), (56) and (58) continue to rotate, the pressure of the pressurized fluid (84) within the exhaust chamber (118) continues to build and the temperature of the pressurized fluid (84) also increases.

As shown in FIG. 23, the casing (12) is provided with a blow-off valve (362) in fluid communication with the exhaust chamber (118). The blow-off valve (362) may, of course, be set at any desired temperature or pressure. Once this pressure is attained, the blow-off valve (362) opens up communication of the exhaust chamber (118) with an overflow hose (364) to return the pressurized fluid (84) directly to the heating chamber (100). In this manner, energy is returned to the system by using rotation of the wheels (354) to motivate the vanes (46), (48), (56) and (58), and heat and pressurize the pressurized fluid (84) in the motor (10). Additionally, during braking, the computer controlled switching system (146) may be used to actuate valves (138) and (144), and to close valve (140) to allow pressurized fluid (84) to pass from the pressure hose (104), through the first transfer hose (122), through the valve (144), through the inlet (22), and directly into the exhaust chamber (118) to provide a back pressure into the hollow interior (24) of the motor (10). This back pressure operates to slow the rotation of the vanes (46), (48), (56) and (58) and, in turn, the wheels (354) of the motor vehicle (342) more quickly, and provides a larger volume of pressurized fluid (84) to pressurize and heat, and return through the blow-off valve (362) and overflow hose (364) to the heating chamber (100). This provides added braking force, and an increased volume of pressurized fluid (84) to heat and pressurize during the braking operation.

If it is desired to reverse the motor vehicle (342), the reverse lever (360) is actuated, thereby signaling the computer controlled switching system (146) to actuate valves (138), (140), (142) and (144) to reverse the flow of pressurized fluid (84) through the hollow interior (24) of the motor (10). When the reverse lever (360) is actuated, the pressurized fluid (84) passes through the pressure hose (104), through the valve (138), through the first transfer hose (122), through the fourth valve (144), and through the outlet (22), into the exhaust chamber (118). The pressurized fluid (84) passes through the hollow interior (24) and out through the inlet (20) to the second valve (140). From the second valve (140), the pressurized fluid (84) passes through the second transfer hose (128), the third valve (142), and the return hose (106), to return to the condenser (108). By reversing the flow of pressurized fluid (84) through the hollow interior (24), the vanes (46), (48), (56) and (58) rotate the drive shaft (14) in a reverse direction, which, in turn, rotates the gear (44) and gear (50) in a reverse direction, thereby rotating the axle (52) and wheels (354) in a reverse direction as well. If desired, the reverse lever (360) may be used as an alternative to the brake (358) to provide the most braking assist to the motor vehicle (342). Accordingly, not only does this assembly reduce the need for high wear pads or shoes in a braking system, but also extracts energy from the braking process and returns the energy to the heating chamber (100) in the form of pressurized fluid (84) having increased heat and/or pressure.

Figure 24:
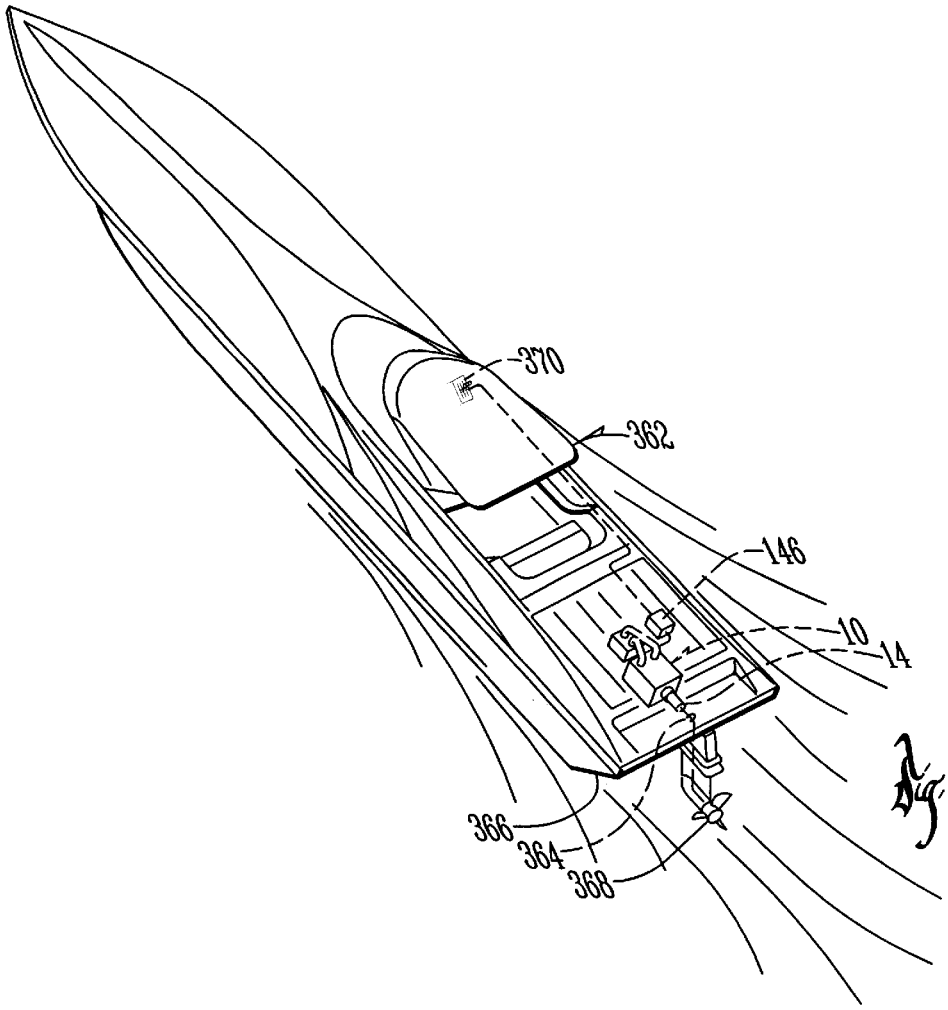
FIG. 24 illustrates a side perspective view in partial cutaway of a watercraft incorporating the motor of the present invention.

As shown in FIG. 24, the motor (10) may be used in association with large or small watercraft (362). In this adaptation of the motor (10), the drive shaft (14) extends through an aperture (364) provided in the stern (366) of the watercraft (362). The drive shaft (14) is secured to a propeller (368) such as those well known in the art. In this application as well, the computer controlled switching system (146) is coupled to a throttle lever (370). When the throttle lever (370) is pulled toward the stern (366) of the water craft (362), the computer controlled switching system (146) reverses the flow of pressurized fluid (84) through the motor (10), thereby providing braking and reversing the watercraft (362). Pulling the throttle lever (370) to the stern (366) reverses the rotation of the propeller (368) thereby eliminating the need for a separate reverse gear. Also, as the motor produces efficient torque over a wide range of speeds, there is no need for a prior art transmission. It should be noted that the motor (10) may be used in watercraft ranging from personal watercraft to large ships, with the motor (10) being sized and constructed to accommodate such diverse applications.

Figure 25:
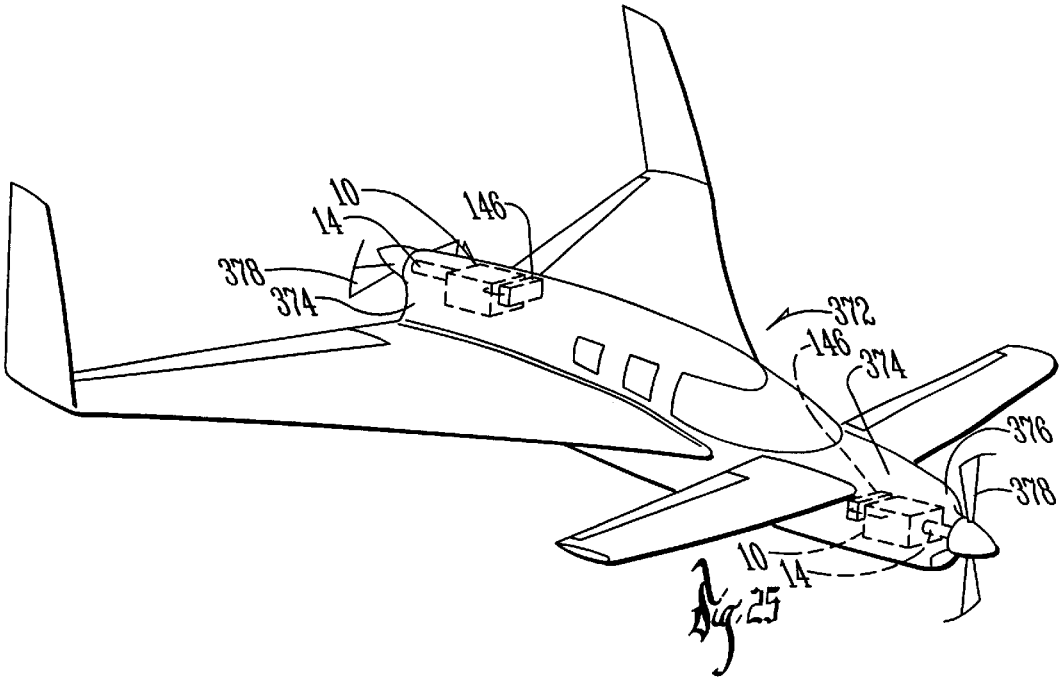
FIG. 25 illustrates a top perspective view in partial cutaway of a propeller driven aircraft incorporating the motor of the present invention.

As shown in FIG. 25, the motor (10) is adapted for use in a propeller driven aircraft (372). The motor (10) is preferably provided within the engine compartment (374) of the propeller driven aircraft (372) with the drive shaft (14) extending through the front (376) of the propeller driven aircraft (372). The drive shaft (14) is coupled directly to a propeller (378) without the need for intermediate gearing or a transmission. The computer controlled switching system (146) is coupled directly to the motor (10) to allow reversing of the propeller (378) for use when the propeller driven aircraft (372) is on the ground.

Figure 26:
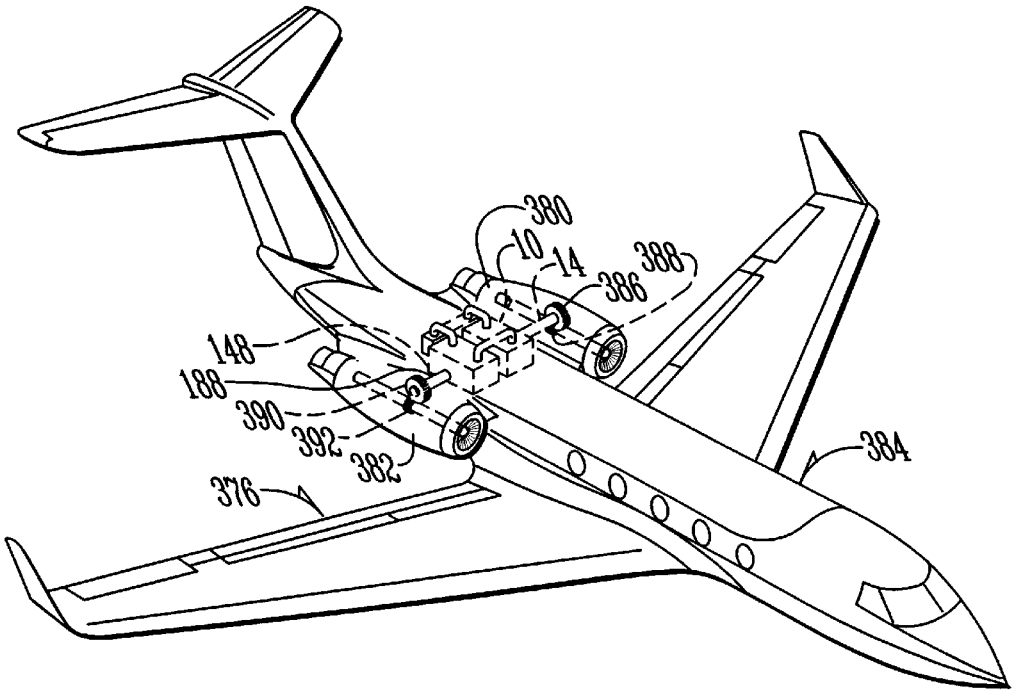
FIG. 26 illustrates a top perspective view in partial cutaway of a turbine driven aircraft incorporating the motor of the present invention.

In yet another application of the motor (10) of the present invention, as shown in FIG. 26, the motor (10) may be used in conjunction with the auxiliary motor (148) to drive a first turbine (380) and second turbine (382) of a turbine driven aircraft (384). In the preferred embodiment, the drive shaft (14) of the motor (10) is provided with a large gear (386) which is coupled to a smaller gear (388) which, in turn, is coupled to the first turbine (380) in a manner such as that known in the art. Similarly, the auxilliary drive shaft (188) of the auxiliary motor (148) is provided with a large gear (390) which, in turn, is coupled to a smaller gear (392) coupled to the second turbine (382) in a manner such as that known in the art.

Figure 27:
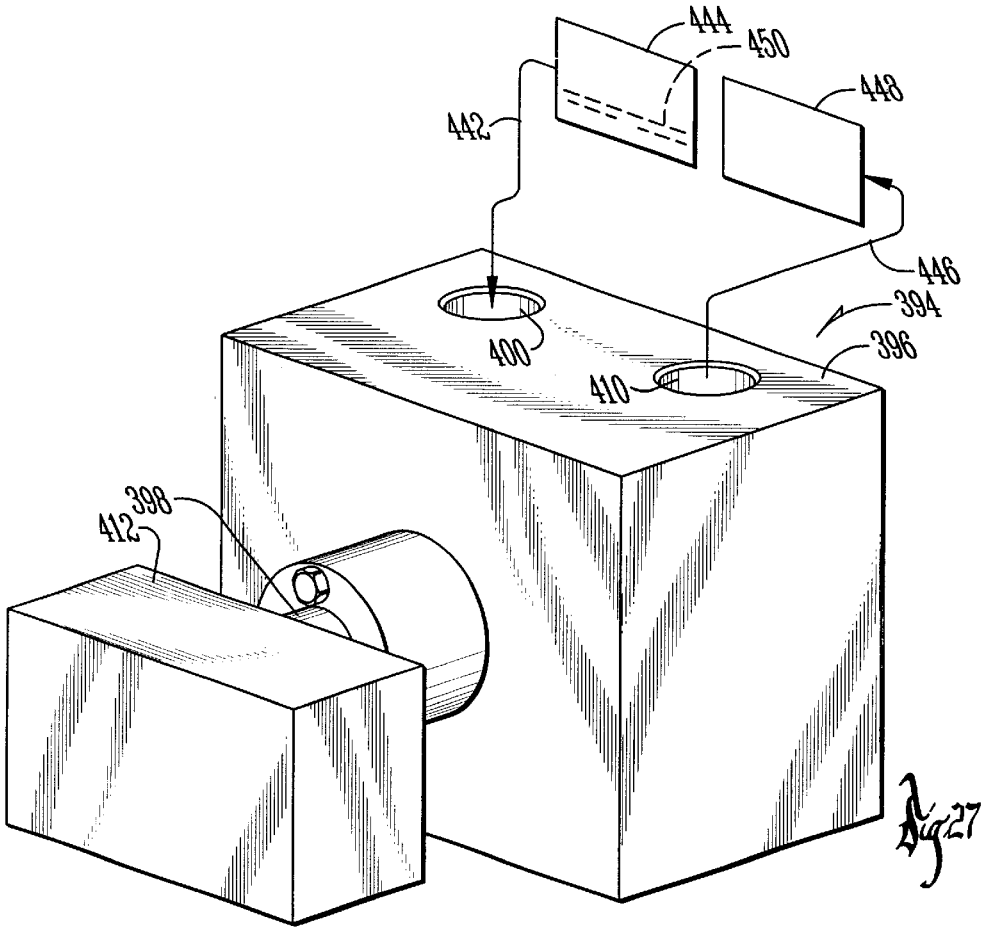
FIG. 27 illustrates a front perspective view of a fifth alternative embodiment of the present invention.
Figure 28:
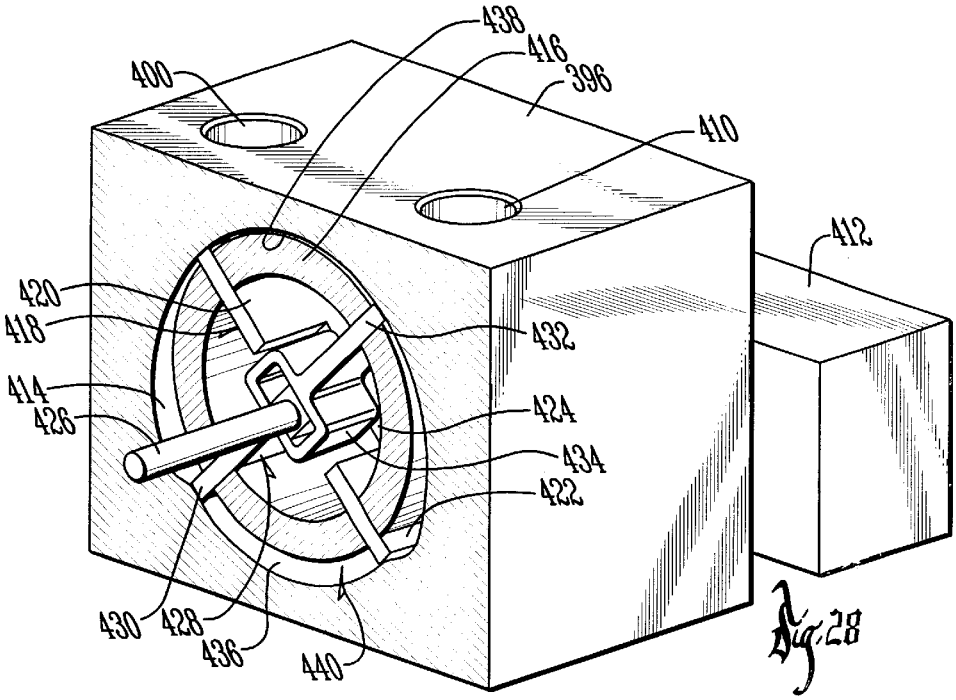
FIG. 28 illustrates a rear perspective view of the fifth alternative embodiment shown in FIG. 16, shown with the rear of the case and the bushings removed

In yet another alternative embodiment of the present invention, a pump (394) is provided with a casing (396), a drive shaft (398), an inlet (400) and an outlet (410). (FIG. 27). The drive shaft (398) is coupled to a rotational motion generator (412) such as a gasoline engine, a diesel engine, electric engine or other rotational motion generator such as those known in the art. As shown in FIG. 28, the casing (396) defines an outer race (414) within which is provided an inner drum (416). The inner drum (416) is provided with a first vane assembly (418) including a first vane (420) and a third vane (422) coupled together by a first lost motion linkage (424) provided around a drum shaft (426). A second vane assembly (428) is provided with a second vane (430) and a fourth vane (432), coupled by a second lost motion linkage (434). The first vane assembly (418) and second vane assembly (428) are provided within the inner drum (416) and around the drum shaft (426) in a manner such as that described above in relationship to the motor (10).

The outer race (414) includes an arcuate surface (436) and a ceiling (438). Together the outer race (414) and inner drum (416) define a hollow interior (440) of the pump (394). As shown in FIG. 27, a suction hose (442) is coupled on one end to the inlet (400) and provided with its other end in a fluid supply (444), such as a fluid spill or a container to which it is desired to apply a vacuum. Coupled to the outlet (410) is an exhaust hose (446) which, in turn, is provided into communication with a receptacle (448) such as a barrel, drum or drain. When it is desired to operate the pump (394), the rotational energy generator (412) is operated to rotate the drive shaft (398). As the drive shaft (398) rotates, the inner drum (416) revolves, causing the vanes (420), (422), (430) and (432) to alternatively extend and retract relative to the inner drum (416), as described above, to generate a vacuum within the hollow interior (440), and draw fluid (450), such as water or a gas, from the fluid supply (444) through the suction hose (442. (FIGS. 27–28). Upon entering the casing (396), the fluid (450) is driven by the vanes (420), (422), (430) and (432), out of the outlet (410) through the exhaust hose (446) and into the receptacle (448). (FIGS. 27–28). If it is desired to move the fluid (450), from the receptacle (448) to the fluid supply (444), the rotational energy generator (412) is simply reversed, thereby causing the vanes (420), (422), (430) and (432) to reverse their motion and drive the fluid (450) in a reverse direction through the hollow interior (440) of the pump (394) and back out through the suction hose (442).

Although the invention has been described with respect to a preferred embodiment thereof, it is to be also understood that it is not to be so limited, since changes and modifications can be made therein which are within the full intended scope of this invention as defined by the appended claims. For example, it should be noted that the first vane assembly (44) and second vane assembly (54) may be replaced with a cylinder provided within the inner drum (28) and coupled to a plurality of separate vanes pivotally coupled thereto. It is additionally anticipated that the motor may be constructed of any suitable size, ranging in sizes from less than a millimeter to several meters in diameter. It is also anticipated that any suitable pressurized fluid, such as pressurized air, pressurized water, pressurized silicon or any liquid or gas may be used to rotate the vanes (46), (48), (56) and (58).

What is claimed is:

1. A motor comprising:

(a) an outer race centered about a first axis;

(b) an inner race centered about a second axis;

(c) wherein said first axis is different from said second axis;

(d) wherein said first axis is parallel to said second axis; and (e) a first vane coupled for movement relative to a first portion of said inner race;

(f) a second vane coupled for movement relative to a second portion of said inner race; said first and second vanes defining a one-piece U-shaped cutout portion;

(g) wherein said inner race is rotatable between a first position wherein said outer race is closer to said first portion of said inner race than said second portion of said inner race, and a second position wherein said outer race is closer to said second portion of said inner race than said first portion of said inner race (h) wherein said first portion of said inner race is provided with a first aperture;

(i) wherein said first vane extends at least partially into said first aperture;

(j) wherein said first vane is adapted for movement relative to said first aperture;

(k) wherein said second portion of said inner race is provided with a second aperture;

(l) wherein said second vane extends at least partially into said second aperture;

(m) wherein said second vane is adapted for movement relative to said second aperture;

(n) wherein said inner race is also provided with an interior and an exterior;

(o) first means coupled to said first vane for retracting at least a first portion of said first vane through said first aperture into said interior of said inner race as said inner race rotates toward said first position and for extending at least a second portion of said first vane through said first aperture to said exterior of said inner race as said inner race rotates toward said second position; and (p) second means coupled to said second vane for retracting at least a first portion of said second vane through said second aperture into said interior of said inner race as said inner race rotates toward said second position and for extending at least a second portion of said second vane through said second aperture to said exterior of said inner race as said inner race rotates toward said first position.

2. The motor of claim 1, further comprising:

(a) a first ear secured to said first vane;

(b) a second ear secured to said second vane; and (c) a guide plate having a first slot provided around said first ear and a second slot provided around said second ear.

3. The motor of claim 2, further comprising:

(a) means for decreasing a first fluid drag coefficient associated with said first vane as said inner race rotates toward said first position;

(b) means for increasing said first fluid drag coefficient associated with said first vane as said inner race rotates toward said second position;

(c) means for decreasing a second fluid drag coefficient associated with said second vane as said inner race rotates toward said second position; and (d) means for increasing said second fluid drag coefficient associated with said second vane as said inner race rotates toward said first position.

4. The motor of claim 2, further comprising:

(a) a third vane coupled for movement relative to said inner race;

(b) a third ear secured to said third vane and provided within a third slot provided in said guide plate;

(c) a fourth vane coupled for movement relative to said inner race; and (d) a fourth ear secured to said fourth vane and provided within a fourth slot provided in said guide plate.

5. The motor of claim 4, further comprising:

(a) a fifth vane coupled for movement relative to said inner race;

(b) a fifth ear secured to said fifth vane and provided within a fifth slot provided in said guide plate, (c) a sixth vane coupled for movement relative to said inner race; and (d) a sixth ear secured to said sixth vane and provided within a sixth slot provided in said guide plate.

6. The motor of claim 5, wherein said first vane is secured to said second vane, said third vane is secured to said fourth vane, and said fifth vane is secured to said sixth vane.

7. The motor of claim 2, wherein said guide plate rotates about said first axis.

8. The motor of claim 1, wherein said first vane is provided with a first end and a second end and wherein said first end of said first vane is slidably coupled to said outer race.

9. The motor of claim 8, further comprising a drive race provided within said inner race.

10. The motor of claim 9, further comprising:

(a) a means for decreasing a first fluid drag coefficient associated with said first vane as said inner race rotates toward said first position;

(b) means for increasing said first fluid drag coefficient associated with said first vane as said inner race rotates toward said second position;

(c) means for decreasing a second fluid drag coefficient associated with said second vane as said inner race rotates toward said second position; and (d) means for increasing said second fluid drag coefficient associated with said second vane as said inner race rotates toward said first position.

11. The motor of claim 9, wherein said drive race is of a construction and placement relative to said first vane, wherein as said inner race is rotated through 360 degrees of rotation relative to said drive race, said second end of said first vane is within five millimeters of said drive race throughout no more than 350 degrees of said 360 degrees of rotation.

12. The motor of claim 9, wherein said drive race is of a construction and placement relative to said first vane, wherein as said inner race is rotated through 360 degrees of rotation relative to said drive race, said second end of said first vane is within five millimeters of said drive race throughout at least 10 degrees of said 360 degrees of rotation, and does not contact said drive race throughout more than 10 degrees of said 360 degrees of rotation.

13. The motor of claim 1, further comprising means for providing a fluid between said inner race and a drive race, and into contact with said first vane at a sufficient pressure to rotationally drive said first vane.

14. The motor of claim 13, wherein said inner race and said outer race define an inlet chamber and an exhaust chamber, further comprising means for switching said providing means from fluid communication with said inlet chamber to fluid communication with said exhaust chamber.

15. The motor of claim 14, wherein said switching means is a computer.

16. The motor of claim 15, further comprising a brake pedal operably coupled to said computer.

17. The motor of claim 14, further comprising a fluid reservoir and means for switching said fluid reservoir from fluid communication with said exhaust chamber to fluid communication with said inlet chamber.

18. The motor of claim 17, wherein said switching means is a computer.

19. The motor of claim 17, wherein said fluid providing means is a heater in heat transmissive proximity to said reservoir.

20. The motor of claim 13, wherein said inner race and said outer race define an inlet chamber and an exhaust chamber, further comprising means for sealing off said exhaust chamber.

21. The motor of claim 20, wherein said sealing means is a computer.

22. The motor of claim 21, further comprising a brake pedal operably coupled to said computer.

23. The motor of claim 1, further comprising:

(a) a second outer race centered about a third axis;

(b) a second inner race centered about a fourth axis;

(c) wherein said third axis is different from said fourth axis;

(d) wherein said third axis is parallel to said fourth axis;

(e) wherein said second vane is coupled for movement relative to said second inner race; and (f) means for communicating fluid between a first space defined by said outer race and said inner race, and a second space defined by said second outer race and said second inner race.

24. The motor of claim 23, wherein said first space includes an inlet chamber in fluid communication with said fluid providing means and an exhaust chamber, wherein said second space includes a second inlet chamber and a second exhaust chamber, further comprising means for switching said fluid providing means from fluid communication with said inlet chamber to fluid communication with said second exhaust chamber.

25. The motor of claim 24, wherein said switching means is a computer.

26. The motor of claim 24, further comprising a fluid reservoir and means for switching said fluid reservoir from fluid communication with said second exhaust chamber to fluid communication with said inlet chamber.

27. The motor of claim 26, wherein said switching means is a computer.

28. The motor of claim 24, wherein said second outer race is larger than said outer race and wherein said second inner raced is larger than said inner race.

29. The motor of claim 1, further comprising means for driving said outer race.

30. The motor of claim 1, further comprising means for driving said inner race.

31. The motor of claim 1, further comprising a propeller coupled to said inner race.

32. The motor of claim 31, further comprising a watercraft having an interior and an exterior, wherein said propeller is provided on said exterior of said watercraft.

33. The motor of claim 32, wherein said inner race is provided on said interior of said watercraft.

34. The motor of claim 31, further comprising an aircraft having an interior and an exterior, wherein said propeller is provided on said exterior of said aircraft.

35. The motor of claim 34, wherein said inner race is provided on said interior of said aircraft.

36. The motor of claim 1, further comprising an axle operably coupled to said second drum.

37. The motor of claim 36, further comprising a wheel coupled to said axle.

38. The motor of claim 37, further comprising a vehicle chassis coupled to said axle.

39. The motor of claim 1, further comprising means for directing a fluid between said outer race and said inner race.

40. The motor of claim 1, further comprising:

(a) means for decreasing a first fluid drag coefficient associated with said first vane as said inner race rotates toward said first position;

(b) means for increasing said first fluid drag coefficient associated with said first vane as said inner race rotates toward said second position;

(c) means for decreasing a second fluid drag coefficient associated with said second vane as said inner race rotates toward said second position; and (d) means for increasing said second fluid drag coefficient associated with said second vane as said inner race rotates toward said first position.

41. The motor of claim 1, further comprising:

(a) a third vane rigidly secured to said first vane; and (b) a fourth vane rigidly secured to said second vane.

42. The motor of claim 41, wherein said first means is a first lost motion linkage secured to said first vane and said third vane, wherein said second means is a second lost motion linkage secured to said second vane and said fourth vane, and further comprising a shaft provided through said first lost motion linkage and through said second lost motion linkage.

43. The motor of claim 42, wherein said first lost motion linkage is secured to said first vane and said third vane in a first generally C-shaped structure defining a first inner space, wherein said second lost motion linkage is secured to said second vane and said fourth vane in a second generally C-shaped structure defining a second inner space.

44. The motor of claim 43, wherein at least a portion of said first lost motion linkage is provided within said second inner space and wherein at least a portion of said second lost motion linkage is provided within said first inner space.

45. The motor of claim 41, further comprising abrasion resistant material secured over at least thirty degrees of said outer race and not more than two hundred degrees of said outer race, wherein said abrasion resistant material is more abrasion resistant than said outer race.

46. The motor of claim 41, wherein said outer race is provided with a first portion and a second portion, wherein said first portion of said outer race is at least ten times closer to said inner race than said second portion of said outer race.

47. The motor of claim 46, wherein said first portion of said outer race is at least fifty times closer to said inner race than said second portion of said outer race.

48. The motor of claim 1, wherein said outer race is of a construction and placement relative to said first vane, wherein as said inner race is rotated through 360 degrees of rotation relative to said outer race, said first vane is within one centimeter of said outer race throughout no more than 350 degrees of said 360 degree rotation.

49. The motor of claim 1, wherein said outer race is of a construction and placement relative to said first vane, wherein as said inner race is rotated through 360 degree rotation relative to said outer race, said first vane is within one centimeter of said outer race throughout at least 10 degrees of said 360 degree rotation, and does not contact said outer race throughout more than 10 degrees of said 360 degrees of rotation.

50. The motor of claim 1, further comprising means for providing a fluid between said inner race and said outer race and into contact with said vane at a sufficient pressure to rotationally drive said vane.

51. The motor of claim 50, wherein said providing means is a heater.

52. The motor of claim 50, further comprising a pressure blow-off valve in fluid communication with an exhaust chamber defined by said inner race and said outer race.

53. A motor comprising, (a) an outer race centered about a first axis;

(b) an inner race centered about a second axis;

(c) wherein said first axis is different from said second axis;

(d) wherein said first axis is parallel to said second axis;

(e) a first vane coupled for movement relative to said inner race;

(f) a second vane coupled for movement relative to said inner race;

(g) a shaft provided along said first axis;

(h) a lost motion linkage provided around said shaft comprising a one piece U-shaped cut out portion formed by said first and second vanes; and (i) wherein said first vane and said second vane are secured to said lost motion linkage.

54. The motor of claim 53, further comprising:

(a) a second lost motion linkage provided around said shaft;

(b) a third vane coupled for movement relative to said inner race and secured to said second lost motion linkage; and (c) a fourth vane coupled for movement relative to said inner race and secured to said second lost motion linkage.

55. The motor of claim 54, wherein at least a portion of said first lost motion linkage is positioned between said first vane and said third vane, and wherein at least a portion of said second lost motion linkage is positioned between said second vane and said fourth vane.

56. A motor for converting fluid pressure to rotational motivation comprising:

(a) an outer race centered about a first axis;

(b) an inner race centered about a second axis, said inner race being provided with a cylinder defining an interior within said cylinder, an exterior between said cylinder and said outer race, a first aperture, a second aperture, a third aperture and a fourth aperture;

(c) a first vane provided for movement within said first aperture;

(d) a second vane provided for movement within said second aperture; said first and second vanes defining a one-piece U-shaped cutout portion;

(e) a third vane provided for movement within said third aperture;

(f) a fourth vane provided for movement within said fourth aperture;

(g) first means secured to said first vane and said third vane for extending at least a first portion of said first vane into said exterior through said first aperture while retracting at least a first portion of said third vane into said interior and for retracting at least a second portion of said first vane into said interior while extending at least a second portion of said third vane into said exterior;

(h) second means secured to said second vane and said fourth vane for extending at least a first portion of said second vane into said exterior through said second aperture while retracting at least a first portion of said fourth vane into said interior, and for retracting at least a second portion of said second vane into said interior while extending at least a second portion of said fourth vane into said exterior;

(i) wherein said first axis is different than said second axis;

(j) wherein said first axis is parallel to said second axis; and (k) means for providing a fluid into said exterior at a pressure sufficient to cause said first vane to rotationally drive said inner race relative to said outer race.

* * * * *